US007859493B2

(12) United States Patent
Sempel et al.

(10) Patent No.: US 7,859,493 B2
(45) Date of Patent: Dec. 28, 2010

(54) METHOD AND DEVICE FOR DRIVING AN ACTIVE MATRIX DISPLAY PANEL

(75) Inventors: Adrianus Sempel, Waalre (NL); Gerben J. Hekstra, Waalre (NL); David A. Fish, Haywards Heath (GB); Alan G. Knapp, Crawley (GB); Andrea Giraldo, 'S-Hertogenbosch (NL); Mark T. Johnson, Veldhoven (NL)

(73) Assignee: TPO Displays Corp., Chu-Nan (TW)

( * ) Notice: Subject to any disclaimer, the term of this patent is extended or adjusted under 35 U.S.C. 154(b) by 1089 days.

(21) Appl. No.: 10/554,324

(22) PCT Filed: Apr. 15, 2004

(86) PCT No.: PCT/IB2004/001227

§ 371 (c)(1),
(2), (4) Date: Oct. 24, 2005

(87) PCT Pub. No.: WO2004/097781

PCT Pub. Date: Nov. 11, 2004

(65) Prior Publication Data

US 2006/0250331 A1 Nov. 9, 2006

(30) Foreign Application Priority Data

Apr. 25, 2003 (GB) ..... 0309402.6

(51) Int. Cl.
*G09G 3/32* (2006.01)

(52) U.S. Cl. ..... 345/82; 345/76; 345/80; 345/204; 345/211; 345/212

(58) Field of Classification Search ..... 345/55, 345/76, 77, 80, 82, 84, 87, 90, 92, 98, 100, 345/204, 211, 212, 213, 214, 690
See application file for complete search history.

(56) References Cited

U.S. PATENT DOCUMENTS 5,903,246 A 5/1999 Dingwall (Continued)

FOREIGN PATENT DOCUMENTS

DE 10006507 A1 8/2001

(Continued)

OTHER PUBLICATIONS

S. C. Tan, et al: 32.4: Designing of Circuit Building Blocks for OLED-on Silicon Microdisplays, SID May 2002, pp. 980-983, XP001134332.

*Primary Examiner*—My-Chau T Tran
(74) *Attorney, Agent, or Firm*—Tim Tingkang Xia; Morris, Manning & Martin, LLP

(57) ABSTRACT

An active matrix display panel comprises a substrate, array of pixel circuits being arranged in a matrix of at least one column and a plurality of rows on the substrate, each pixel circuit comprising a light-emitting element, capable of emitting light of an intensity determined by the value of a current passed through it, and at least one column line, each column line arranged to conduct a reference current, provided by a current driving circuit, when connected to the panel. The pixel circuits in a column are divided into a plurality of groups of at least one pixel circuit. The active matrix display panel comprises at least one current mirror circuit associated with a first group, comprising a first current mirror, arranged to mirror a reference current flowing through a column line to a first current mirror output. Each pixel circuit in the first group comprises at least a first current-memory stage, having an output terminal connected to the light-emitting element, wherein the first current-memory stage is capable of drawing a current determined at least partly by the current mirrored to the first current mirror output through the output terminal. Each current mirror circuit comprises at least one additional current mirror, arranged to mirror a reference current flowing through an associated column line to an additional current mirror output, wherein each additional current mirror output is connected in parallel to the first current mirror output.

15 Claims, 13 Drawing Sheets

U.S. PATENT DOCUMENTS

Figure 1:
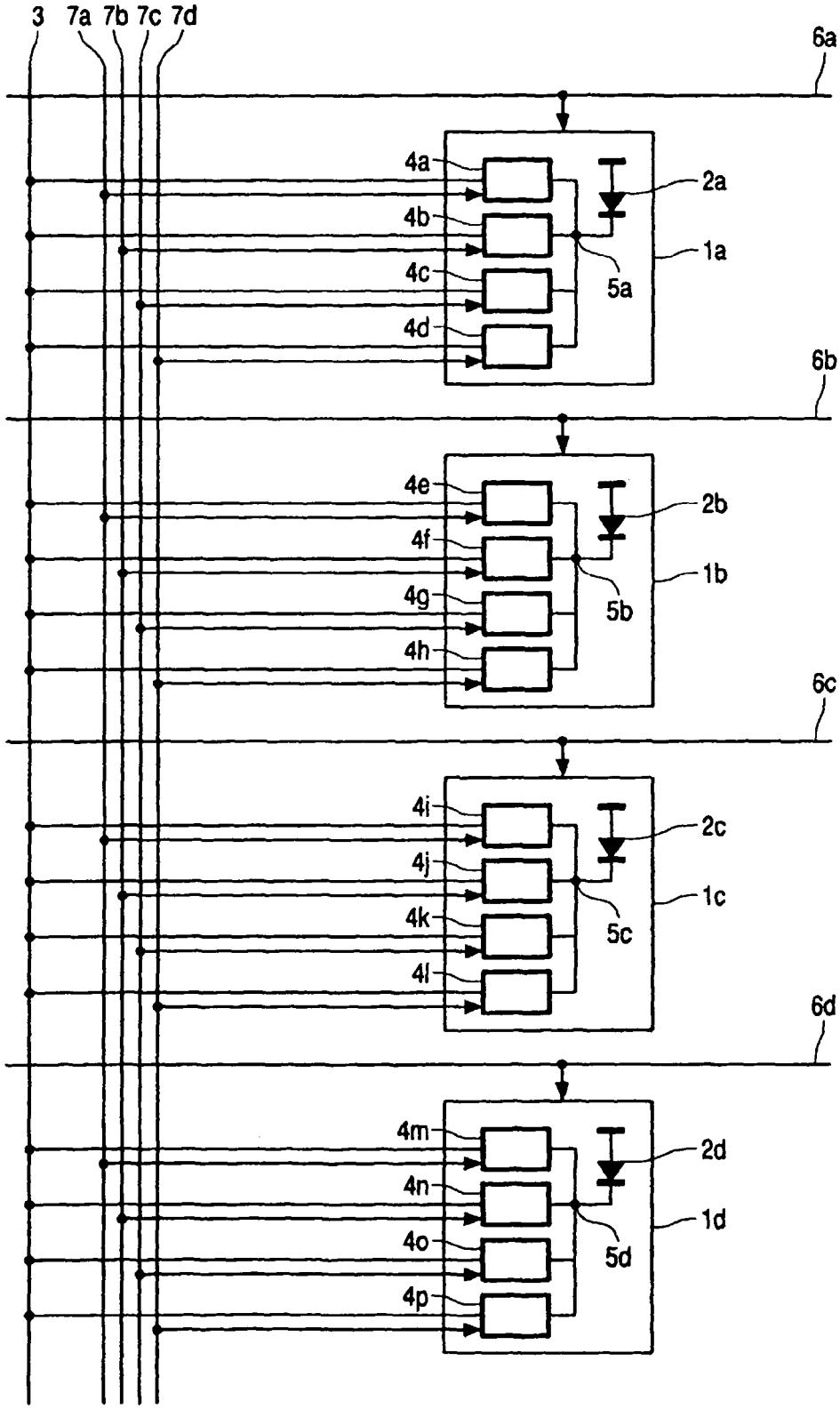

| | | | | |
|---|---|---|---|---|
| 6,020,865 | A | 2/2000 | Okuda et al. | |
| 6,359,605 | B1 | 3/2002 | Knapp et al. | |
| 6,433,488 | B1 * | 8/2002 | Bu | 315/169.3 |
| 6,501,466 | B1 * | 12/2002 | Yamagishi et al. | 345/204 |
| 6,731,273 | B2 * | 5/2004 | Koyama et al. | 345/204 |
| 6,891,520 | B2 * | 5/2005 | Chen et al. | 345/82 |
| 7,075,338 | B2 * | 7/2006 | Mizuno et al. | 327/66 |
| 2002/0008689 | A1 * | 1/2002 | Koyama et al. | 345/100 |
| 2002/0075208 | A1 | 6/2002 | Bae et al. | |
| 2003/0098829 | A1 * | 5/2003 | Chen et al. | 345/82 |
| 2003/0214466 | A1 | 11/2003 | Kimura | |

FOREIGN PATENT DOCUMENTS

| | | | |
|---|---|---|---|
| EP | 0365445 | A2 | 4/1990 |
| EP | 1103946 | A2 | 5/2001 |
| EP | 1193674 | A2 | 4/2002 |

* cited by examiner

METHOD AND DEVICE FOR DRIVING AN ACTIVE MATRIX DISPLAY PANEL

The invention relates to an active matrix display panel, comprising a substrate, an array of pixel circuits being arranged in a matrix of at least one column and a plurality of rows on the substrate, each pixel circuit comprising a light-emitting element, capable of emitting light of an intensity determined by the value of a current passed through it, and at least one column line, each column line arranged to conduct a reference current, provided by a current driving circuit, when connected to the panel, wherein the pixel circuits in a column are divided into a plurality of groups of at least one pixel circuit, wherein the active matrix display panel comprises at least one current mirror circuit associated with a first group, comprising a first current mirror, arranged to mirror a reference current flowing through a column line to a first current mirror output, wherein each pixel circuit in the first group comprises at least a first current-memory stage, having an output terminal connected to the light-emitting element, wherein the first current-memory stage is capable of drawing a current determined at least partly by the current mirrored to the first current mirror output through the output terminal.

The invention further relates to a method of driving such an active matrix display panel, comprising receiving information specifying intensity values of a plurality of light-emitting elements to be displayed within a frame period, and setting a reference current flowing through a column line connectable to the first current mirror to a first level, within the frame period.

The invention also relates to a display device, comprising such an active matrix display panel.

The invention also relates to a device for driving such an active matrix display panel.

An example of an active matrix display panel as defined above is known, e.g. from U.S. Pat. No. 5,903,246. In the known panel, a circuit is coupled to a current source for driving a plurality of active organic light emitting diodes (OLEDs) arranged in a column at a desired brightness. The circuit comprises an input leg of a current mirror for establishing a reference current for driving an active OLED, a plurality of selecting means, responsive to a row select signal, for respectively selecting an OLED from the plurality of active OLEDs; an output leg of a current mirror for supplying a mirror of the established reference current to the selected OLED; and a plurality of charging means for supplying a mirror of the established reference current in order to continuously drive the selected O-LED. The known technique includes separate, digitally adjustable current sources on each column line of the array. For each column, the digitally-programmed current flow terminates with a reference OLED and a series transistor forming the input leg of a distributed current mirror. A reference current is used to establish a proper current by way of distributed current mirror circuitry driving any one of the active O-LED pixels in a column. In particular, a column select conductor, which is coupled to a digitally-programmable current source, supplies current to a transistor and to a reference pixel, both coupled to the last pixel in the column.

In the known circuit, as the panel is scaled up, parasitic capacitance, which increases with the length of the column select conductor, provides a limit to the speed at which the digital current source can vary the new current level for each consecutively selected pixel in the column. In particular, large current swings cannot be accurately imposed within the time available for addressing a row. In addition, it becomes more difficult to match the transistors in the distributed current mirror as they lie further apart, so further decreasing the accuracy with which the current level determining the intensity of light emitted by the light-emitting element can be set within the time available for addressing a row.

It is an object of the invention to provide an active matrix display panel, method of and device for driving such a display panel and display device that allow the current drawn through the light emitting element in a pixel circuit to be set within the time available for each pixel with more accuracy at larger intensity level variations between rows.

This object is achieved by the active matrix display panel according to the invention, which is characterised in that each current mirror circuit comprises at least one additional current mirror, arranged to mirror a reference current flowing through an associated column line to an additional current mirror output, wherein each additional current mirror output is connected in parallel to the first current mirror output.

Because the first and additional current mirrors are comprised in the current-mirror circuit, the accuracy with which the reference current or currents are mirrored is improved, as current mirror components, such as transistors, situated closely together are more likely to be matched. Because two or more current mirrors are used and their outputs are connected in parallel, the mirrored currents are added. Thus larger variations in intensity from one row to the next can be achieved, without large swings in reference current value on the column line. The influence of parasitic capacitance is therefore smaller, the correct reference current value is arrived at more quickly, and the accuracy with which each pixel in the column can be driven is improved. Because a reference current value is provided through the column line(s) and an intensity of the emitted light is determined by the sum of mirrored currents, voltage drops across the column line from one row to the next do not have to be taken into account when setting reference values on the column line, thus taking away the need to account for such voltage drops in the driving algorithms in order to maintain accuracy.

Preferably, the active matrix display panel comprises a row selection line for each row of pixel circuits, wherein at least the first current-memory stage comprises a row select switch, responsive to a signal on the row selection line, and a storage element for storing a signal value determining a current flowing through the output terminal, wherein the row select switch is comprised in a circuit section for providing a row select signal to the storage element.

Thus, it is possible to program different reference current values in the first current-memory stage and vary the reference current from one row to the next. The pixel circuit of each row can be individually addressed by providing a row select signal and setting the current through the column line to the appropriate level.

A first variant of the active matrix display panel comprises at least N column lines for each column of pixel circuits, N being larger than one, wherein the current mirror circuit comprises at least N current mirrors, each arranged to mirror a reference current flowing through an associated one of the column lines to a current mirror output of the current mirror, and an adder for adding currents flowing through the current mirror outputs.

Thus, it is possible to set the reference currents intended for each current mirror separately and simultaneously. This has the advantage that the voltage and current on each of the column lines settle simultaneously. The reference currents to be mirrored and supplied to the adder, each defining a contribution to the current determining the intensity of emitted light are set at approximately the same time. The fraction of the frame period during which each of the contributions is available for addition and supply to the one or more current-memory stages in the pixel circuits is thus relatively large. In a preferred embodiment of this variant, the current mirror circuit comprises at least one feed select switch, interrupting a connection between a current mirror output of an associated current mirror and a column line and responsive to one of at least one feed select signals, wherein the active matrix display panel comprises addressing circuitry, connectable to a display driver for receiving driving information, and arranged to supply each feed select signal to the feed select switches associated to one of the current mirrors.

Thus, it is possible to drive the active matrix display panel in a digital fashion, by selecting current contributions to be added by the adder by means of the feed select signals. One can thus set the N reference current values to a constant value for the duration of a frame period, and drive the pixel in each row in turn by supplying an appropriate combination of feed select signals in accordance with the intensity of light to be emitted by the pixel. This further reduces the variation of reference current values on each column line, thus allowing more time for accurate driving of the pixels.

Preferably, the addressing circuitry comprises at least one addressing line and at least one decoder, connected to the addressing lines by means of separate inputs, and to each of the current mirror switches associated with each current mirror by means of a separate output for each current mirror, the decoder being arranged to convert a digital value communicated over the addressing lines into a combination of feed select signals encoded by the digital value.

This reduces the number of lines on the active matrix display panel substrate needed to provide the N feed select signals to the N current mirror switches from N to a lower value. Each digital value represents a combination of feed select signals. The decoder is arranged to generate the appropriate combination on the basis of the digital value provided on its inputs.

In one embodiment of the invention, the first group comprises M pixel circuits, M being larger than one, wherein the active matrix display panel comprises a local column line for the first group, connecting an output of the adder in the current mirror circuit to an input of a current mirror in each of the M pixel circuits comprising the first current-memory stage.

Thus, the current mirror circuit with the adder for adding the contributions defined by the reference currents is shared by the M pixel circuits. This represents a significant saving in the amount of circuitry on the substrate, as it is not necessary to provide each of the M pixel circuits with N current mirror circuits. One current mirror circuit per pixel circuit, to mirror the current on the local column line, suffices. It is noted that the column of pixel circuits comprises a plurality of groups, so that the local column line provides a reference current to only a sub-set of the pixel circuits in the column. The local column line is therefore shorter than a column line connectable to each of the pixel circuits would be, so that parasitic capacitance on the local column line is less of a problem. Because the local column line will be connected to adjacent pixel circuits in the column, variations in reference current value are not very likely for a display panel displaying normal images. It is further noted that the presence of a row selection line for each row of pixel circuits prevents the reference current value on the local column line from being provided to the current-memory stage of each pixel circuit in the group at the same time, so that the pixels in the group can still be driven separately.

Preferably, the active matrix display panel comprises at least N current dumping circuit stages, each connectable to one of the N column lines by means of a switch, and responsive to one of the N feed select signals supplied to the feed select switches controlling an associated current mirror, such that a connection between a column line and a current dumping circuit stage is established when the connection between the column line and each of the current mirror outputs is interrupted.

By these means, it is ensured that the impedance into each column line remains substantially constant, irrespective of whether the current provided through the column line is drawn by a current mirror or not. Thus, when a current mirror switch is switched on so that the reference current is mirrored by the associated current mirror, the current dumping circuit stage is disconnected and vice versa. This helps to suppress variations in voltage and current through the column line, making shorter settling times possible.

In a further variant of the active matrix display panel, which can be combined with any of the embodiments of the previously described variant, each pixel circuit in the first group comprises K current mirrors, K being larger than one, each having an input and a current-memory stage comprising an output connected to the light-emitting element, a storage element for storing a signal value determining a current flowing through the output and a sub-frame select switch, responsive to one of K sub-frame select signals, wherein each sub-frame select switch is comprised in a circuit section between the input of the current mirror and the storage element, wherein the active matrix display panel comprises addressing circuitry, having at least one input terminal for receiving driving information from a display driver connected to the active matrix display panel, and arranged to supply each sub-frame select signal to an associated one of the K sub-frame select switches.

This variant allows a method of driving the active matrix display panel in which current contributions are added, as in the previously described variant, because each of the K current-memory stages has an output connected to the light-emitting element. However, because each current-memory stage comprises the storage element, and because each current-memory stage is separately programmable, by supplying a sub-frame select signal to only the current-memory stage being programmed, it is possible to sequentially program the various current contributions. It is thus possible to supply a first reference current determining a first contribution during a first sub-frame period, and a second reference current determining a second contribution during a second sub-frame period. The first contribution is maintained, thanks to the storage element, and added to the second contribution, because both current-memory stages comprise an output connected to the light-emitting element. Because contributions can be added, it becomes possible to supply smaller reference currents, thus avoiding the above-described problems caused by the parasitic capacitance of the column line(s).

One embodiment of this variant comprises at least one reset line, and at least one current-memory stage comprises a reset switch, responsive to a reset signal on the reset line to adjust the signal value stored by the storage element to a default value.

Thus, after programming a contribution increasing the current flowing through the light-emitting element, it is also possible to take away a contribution to the total current, thus decreasing the total current flowing through the light-emitting element. This is useful, as it allows each of the current contributions to be present for a different sub-period of the frame time. Because the observed light intensity depends also on the length of time during which light is emitted, as well as on the current flowing through the light-emitting element (the eye of an observer functions as an integrator), the number of different intensity levels is effectively increased. Because the active matrix display panel comprises a reset line in addition to column lines, and the reset line controls a switch, resetting is effectively done by means of a digital signal. This is much faster than setting a reference current value on a column line to the default value.

According to another aspect of the invention, the method of driving an active matrix display panel according to the invention is characterised by, within the frame period, setting a reference current flowing through a column line connectable to an additional current mirror comprised in the current mirror circuit and arranged to mirror a reference current flowing through the column line to an additional current mirror output connected in parallel to the first current mirror output, to a second level.

The first and second level may be the same. The method has the advantage that the current determining the light-intensity is determined by the sum of the two levels, so that each level can be relatively low. Therefore, large swings in current and voltage on the column line(s), which occur when one pixel is to emit light at a high intensity and a next pixel at a very low intensity, are prevented. Thus, the negative effects of the column capacitance are prevented. The method thus allows larger differences in intensity, or longer column lines, i.e. more pixel circuits in a column, since the time needed to allow each reference current to settle to the intended level is shorter.

In one variant of the method, wherein the active matrix display panel comprises at least N column lines for each row of pixels, N being larger than one, wherein the current mirror circuit comprises N current mirrors, each connectable to an associated one of the N column lines and arranged to mirror a reference current flowing through an associated one of the N column lines to a current mirror output of the current mirror, wherein the current mirror circuit comprises an adder for adding currents flowing through the N current mirror outputs, a reference current is set on each of the column lines.

Thus, the reference currents intended for each current mirror are set separately and simultaneously. This has the advantage that the voltage and current on each of the column lines settle simultaneously. The reference currents to be mirrored and supplied to the adder, each defining a contribution to the current determining the intensity of emitted light, are set at approximately the same time. The fraction of the frame period during which each of the contributions is available for addition and supply to the one or more current-memory stages in the pixel circuits is thus relatively large.

Preferably, the method comprises selectively connecting the N current mirrors to the associated N column lines in accordance with the received information.

Thus, because the N current mirrors are selectively connected, it is possible to select the particular contributions to the total current that flows through the light-emitting element. It is thus possible to set different total currents for each pixel whilst varying the reference currents flowing through the column lines only slightly or not at all. This means that less time is needed to allow reference currents to settle, so more of the frame time is available for actually driving the pixels circuits.

In another variant of the method of the invention, which may be combined with the embodiments described above, wherein the active matrix display panel comprises a row selection line for each row of pixel circuits, wherein at least the first current-memory stage comprises a row select switch, responsive to a signal on the row selection line, and a storage element for storing a signal value determining a current flowing through the output terminal, wherein the row select switch is comprised in a circuit section for providing a signal to the storage element, the frame period comprises a plurality of sub-frame periods and the method comprises providing a row select signal closing the row select switch on each row selection line in turn within each sub-frame period.

Thus, each pixel circuit is addressed at least twice every frame period, which allows a greater number of different intensity levels.

A preferred embodiment, wherein each pixel circuit comprises K current mirrors, each comprising a current-memory stage, K being larger than one, each current-memory stage having an output connected to the light-emitting element and a storage element for storing a signal value determining a current flowing through an output, comprises selectively providing a signal value for storage in the storage element to a different one of the K current-memory stages substantially simultaneously with the row select signal.

Thus, it is possible to make use of the fact that the perceived intensity also depends on the length of time during which light is emitted. By being able to set the current through the light-emitting element to a certain value for the duration of only part of the frame period the number of different perceived intensities that can be displayed is effectively increased.

Another embodiment of the method according to the invention comprises providing a reset signal to at least one of the current-memory stages, to adjust the signal value stored by the storage element to a default value, within the frame period.

Thus, after programming a contribution increasing the current flowing through the light-emitting element, a contribution to the total current is taken away again, within the frame period, thus decreasing the total current flowing through the light-emitting element. This is useful, as it allows each of the current contributions to be present for a different sub-period of the frame time. Because the observed light intensity depends also on the length of time during which light is emitted, as well as on the current flowing through the light-emitting element (the eye of an observer functions as an integrator), the number of different intensity levels is effectively increased.

Preferably, the method comprises providing at least one further reset signal to at least a further one of the K current-memory stages, to adjust the signal value stored by the storage element of the further current-memory stage to a default value, within the frame period.

Thus, the intensity of light emitted by a pixel during a frame period is increased in steps and at least two of the contributions to the total current determining that intensities are subtracted again from the total before the end of the frame period.

In a preferred embodiment, the method comprises providing each reset signal at a separate point in time, and in an even more preferred embodiment, in each sub-frame period, a signal value for storage in the storage element is selectively provided to a different one of a number of the K current-memory stages in order, and the reset signals are provided to each of the number of current-memory stages in reverse order.

Thus, a gradual resetting scheme is realised. The scheme has the advantage of eliminating artefacts, which occur especially when the active matrix display is used to display moving images and the current-memory stages are abruptly reset.

According to another aspect of the invention, there is provided a display device, comprising an active matrix display panel according to the invention.

Such a display device, which can be implemented in the shape of a television screen or computer monitor, can be addressed at higher frequencies for a given column size, i.e.

number of pixels per column. Of course the invention can also be used to achieve the advantage of having more pixel circuits in a column connected to a single column line for a given frequency. In this case, the effect is to decrease the number of column lines per column of pixel circuits. The amount of driving circuitry is thus reduced, since separate current drivers are needed for each column line.

According to a further aspect of the invention, there is provided a device for driving an active matrix display panel according to the invention, having an input for receiving information specifying intensity values of a plurality of light-emitting elements to be displayed within a frame period, and arranged to carry out a method according to the invention.

These and other aspects of the invention will be apparent from and elucidated with reference to the embodiments described hereinafter.

Figure 2:
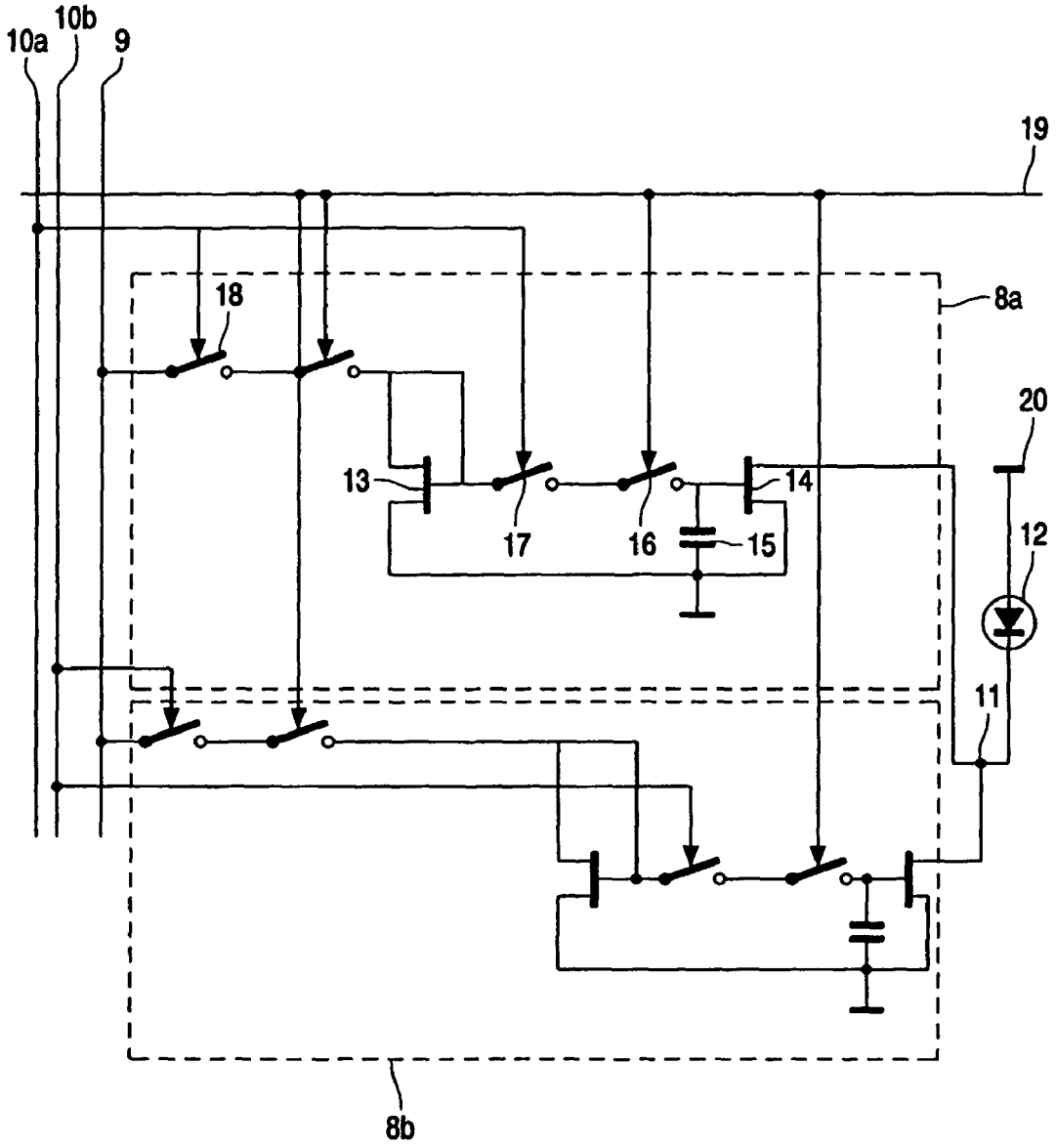
Figure 3:
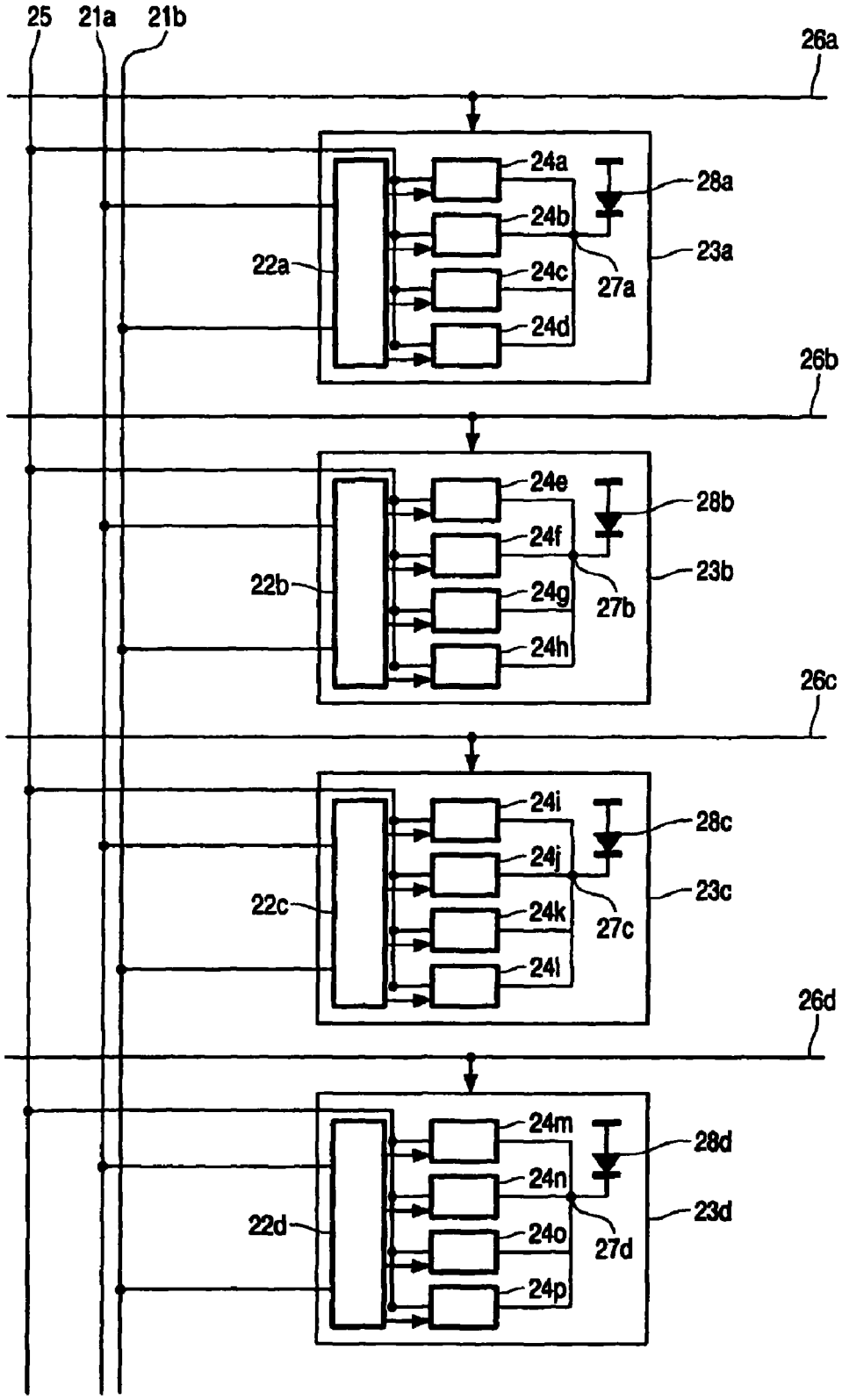
Figure 4:
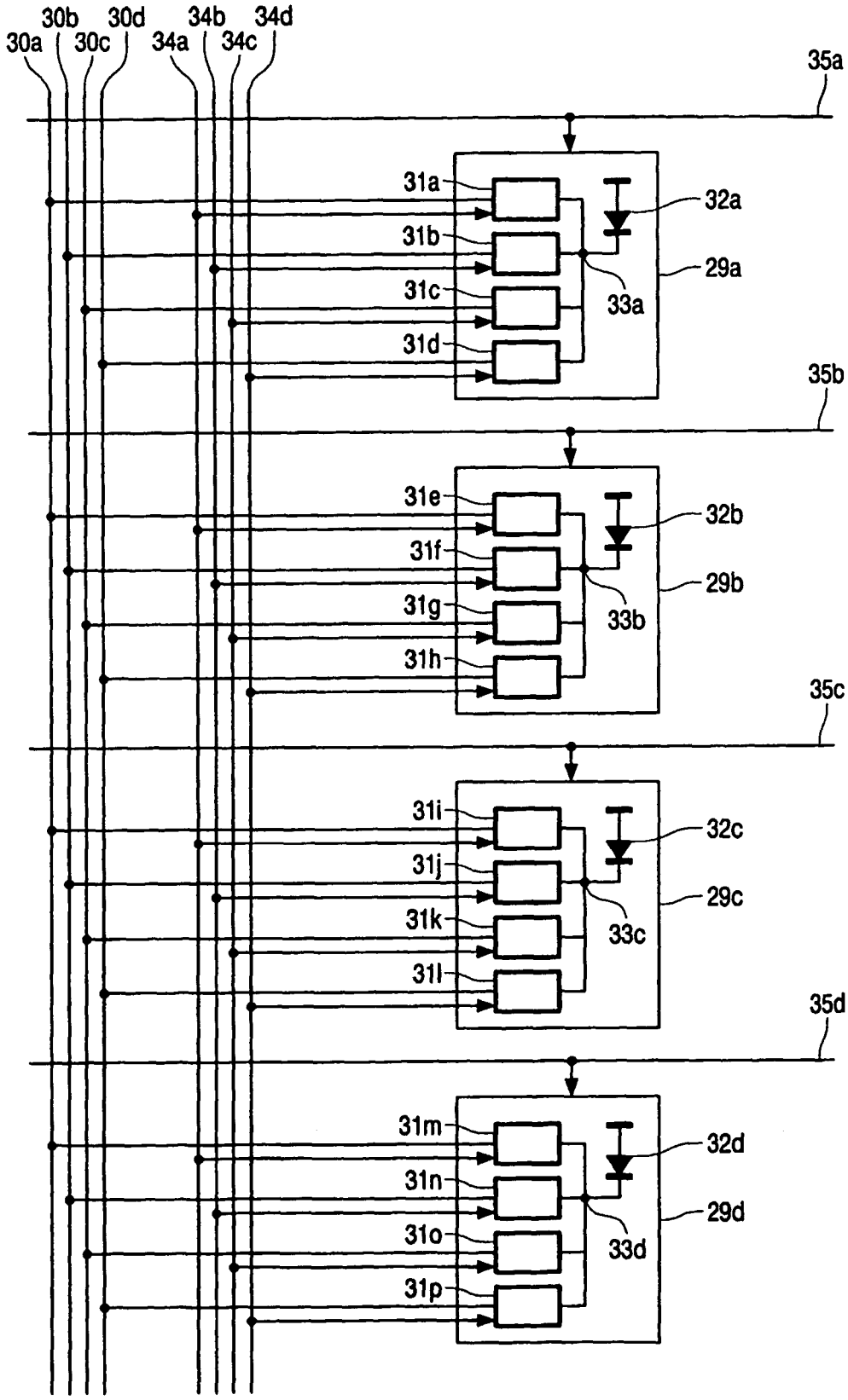
Figure 5:
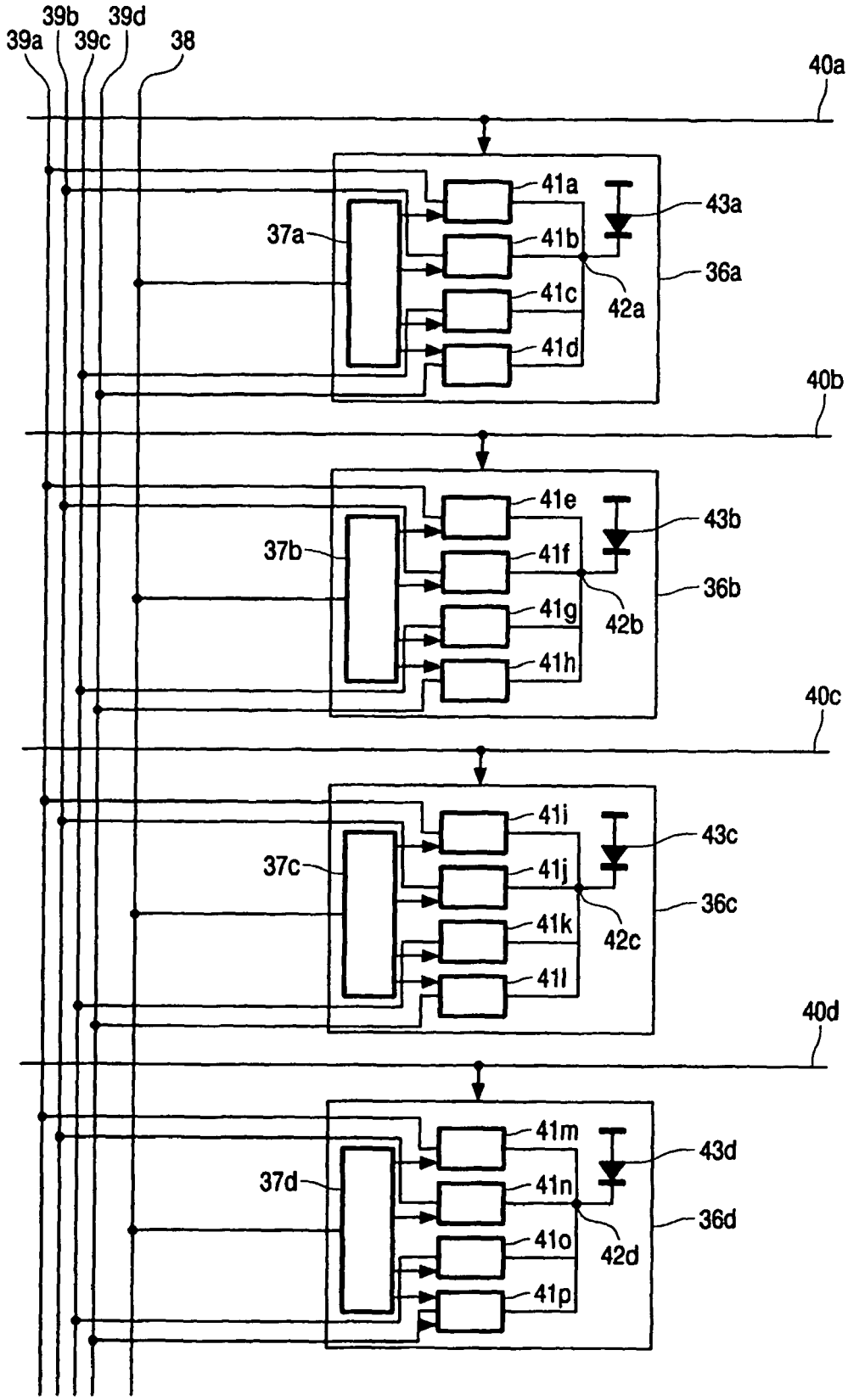
Figure 6:
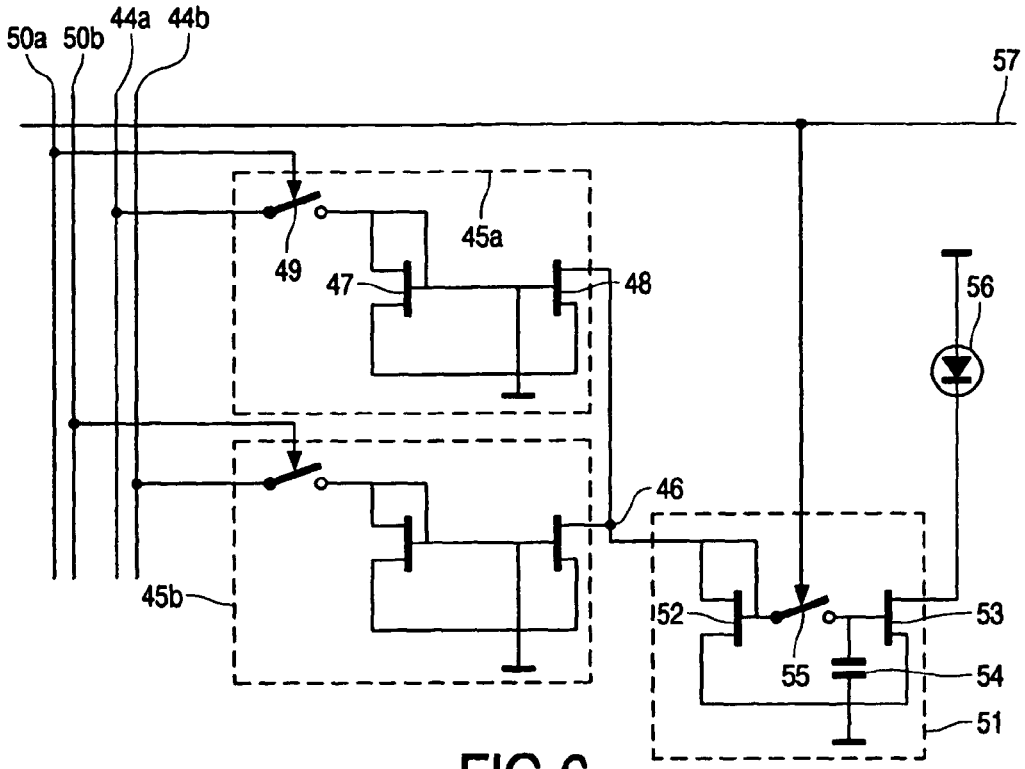
Figure 7:
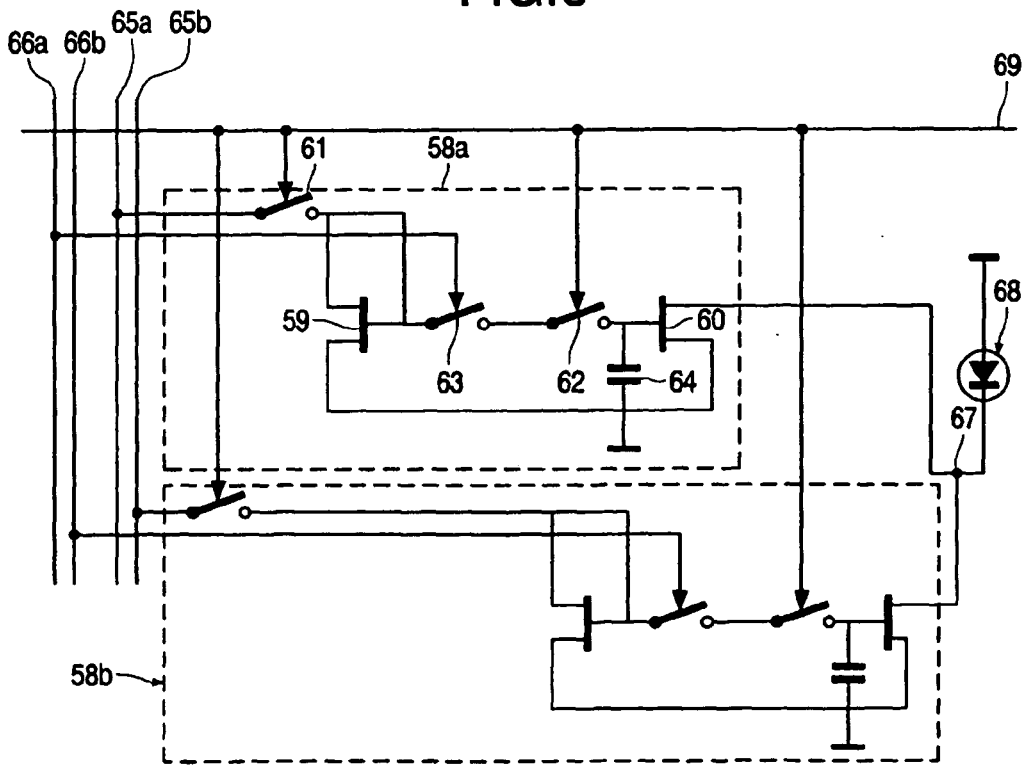
Figure 8:
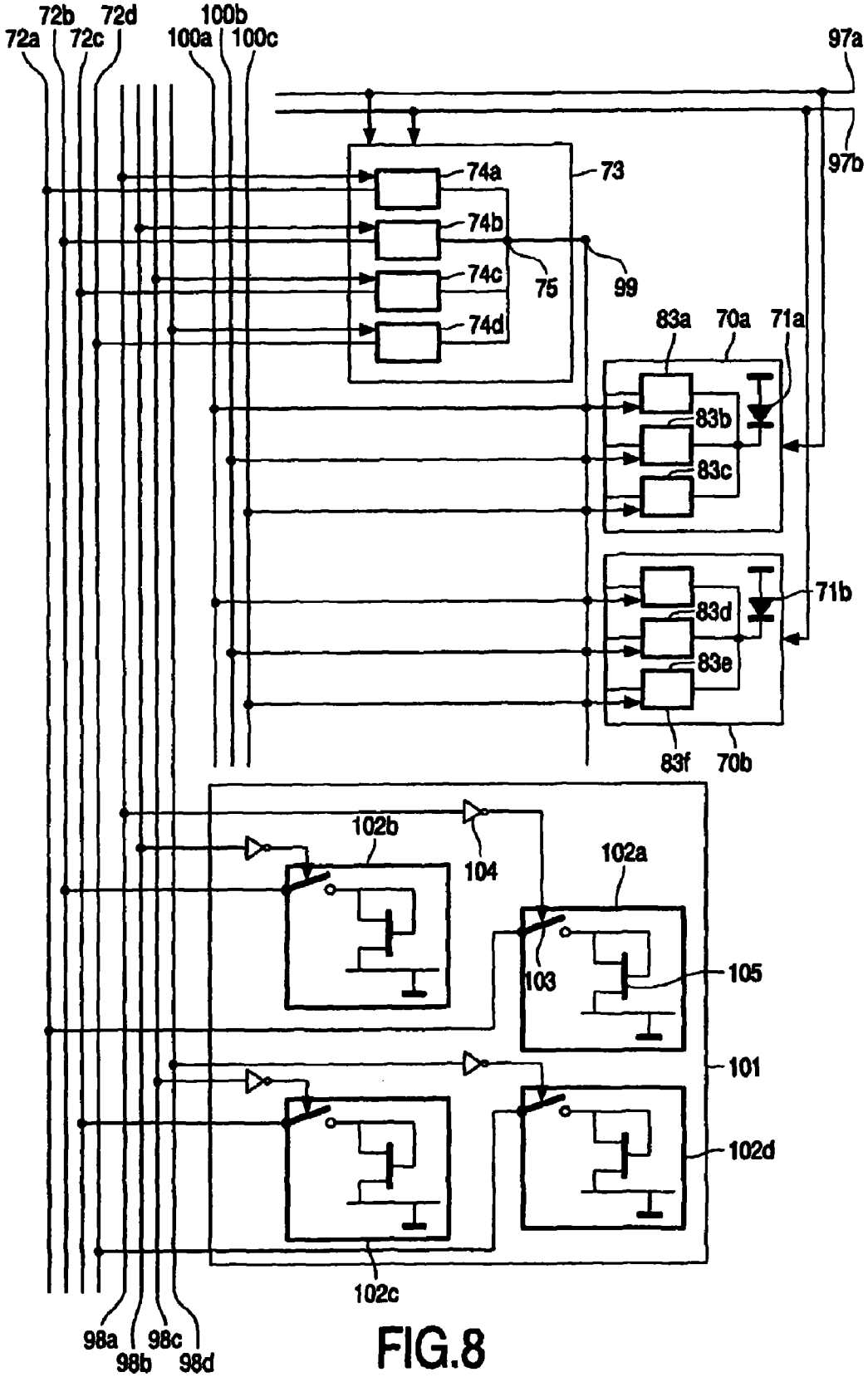
Figure 9:
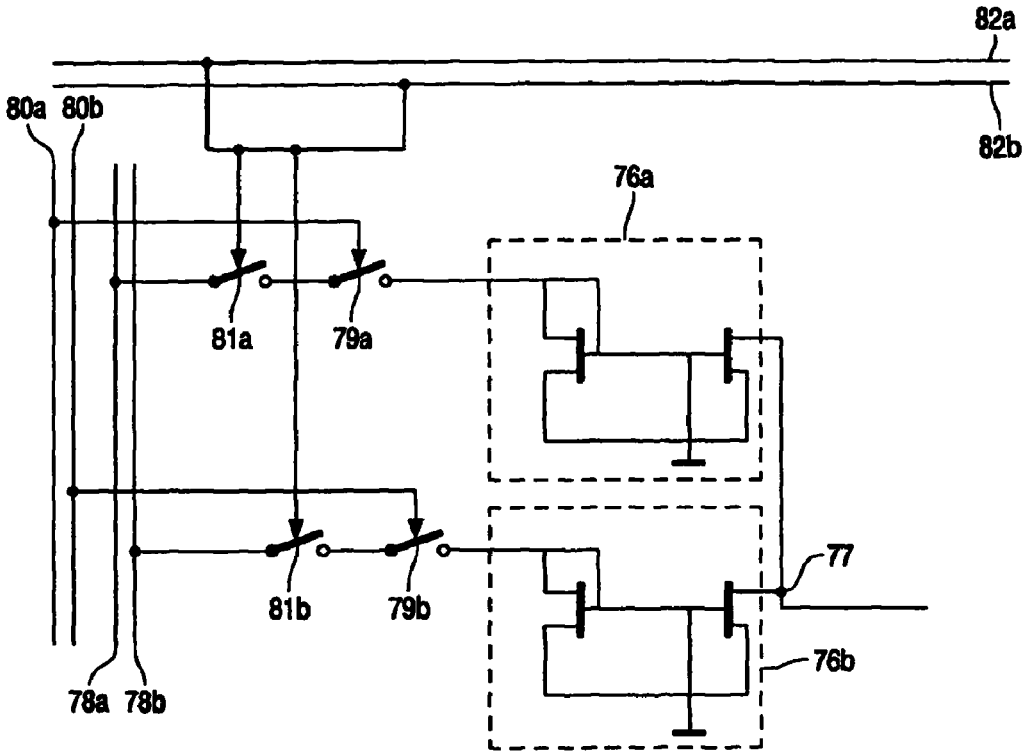
Figure 10:
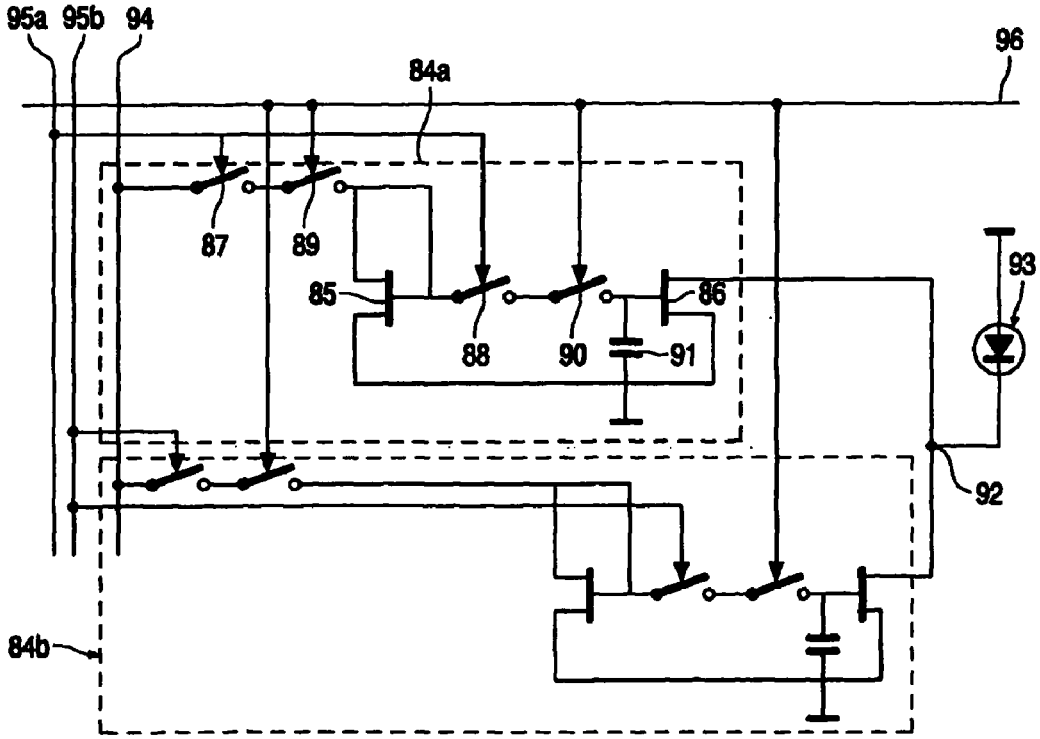
Figure 11:
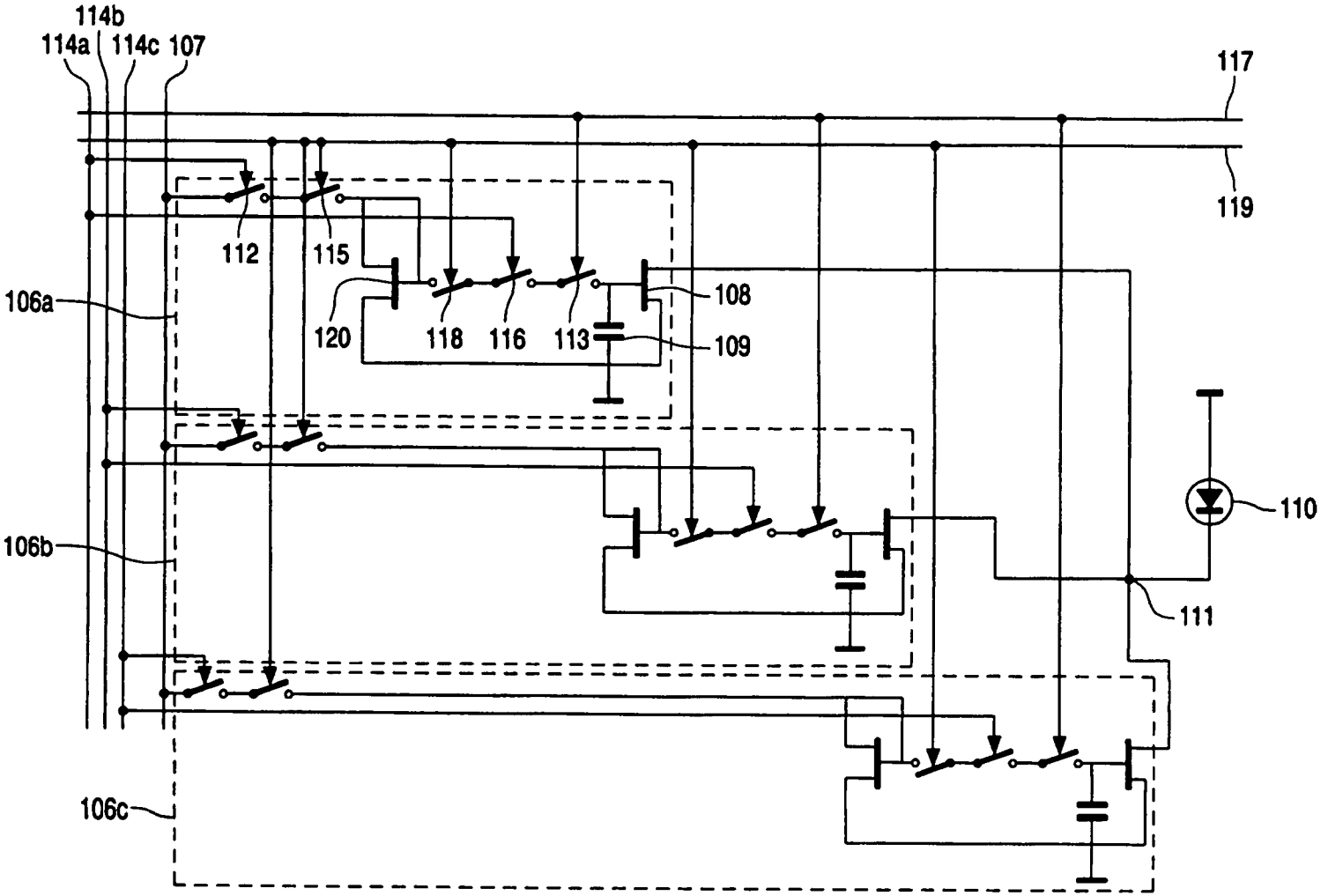
Figure 12:
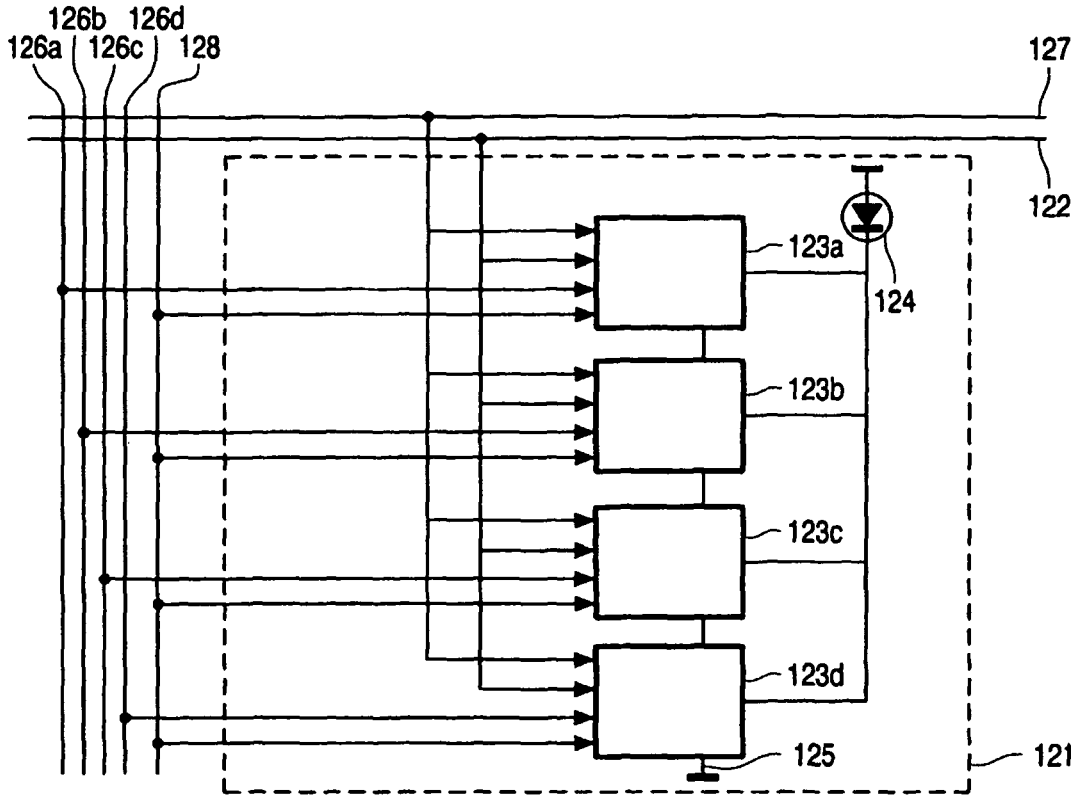
Figure 13:
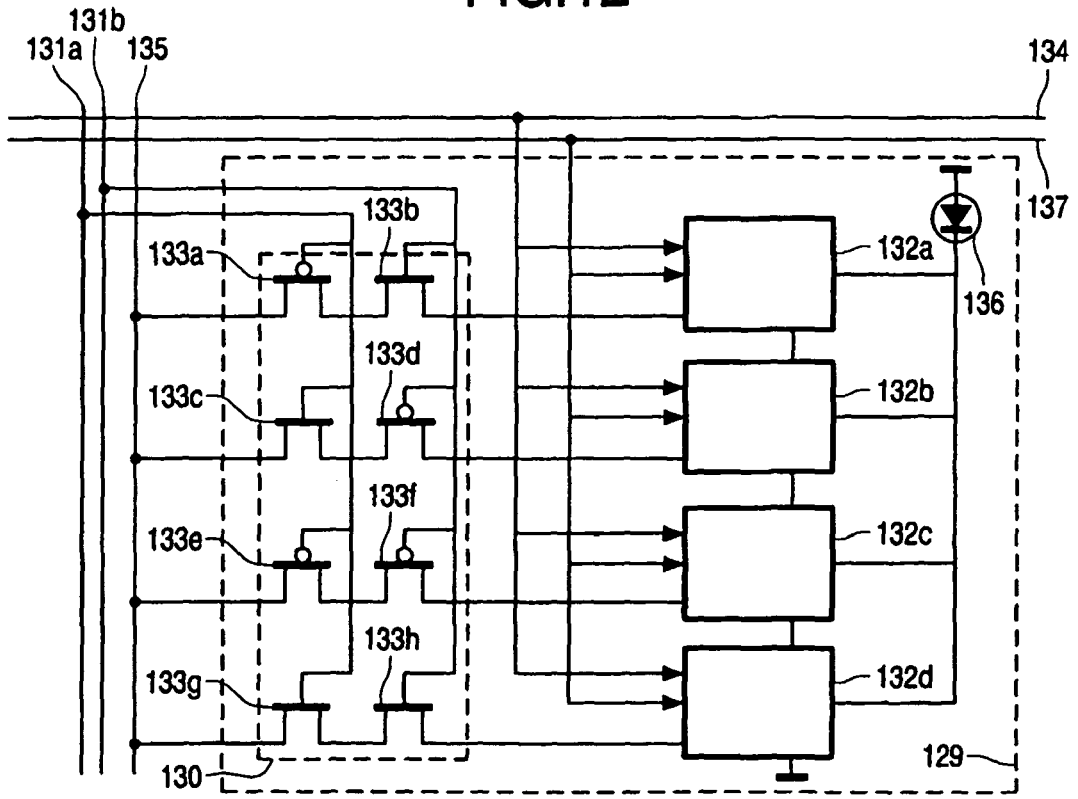
Figure 14:
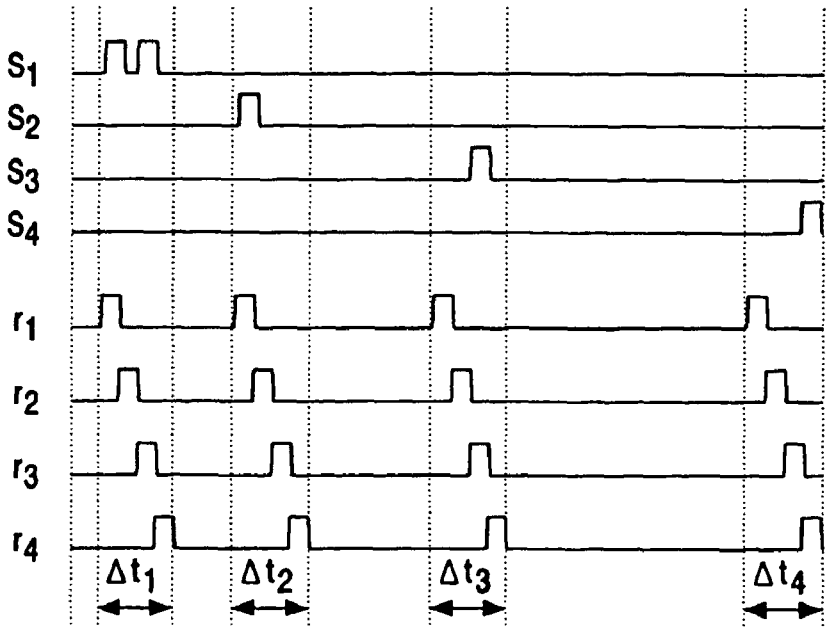
Figure 15:
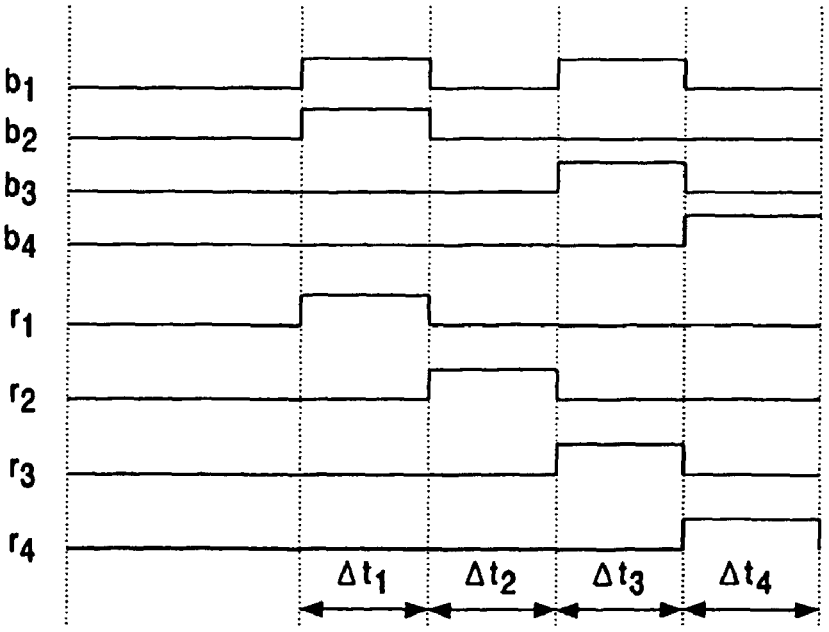
Figure 16:
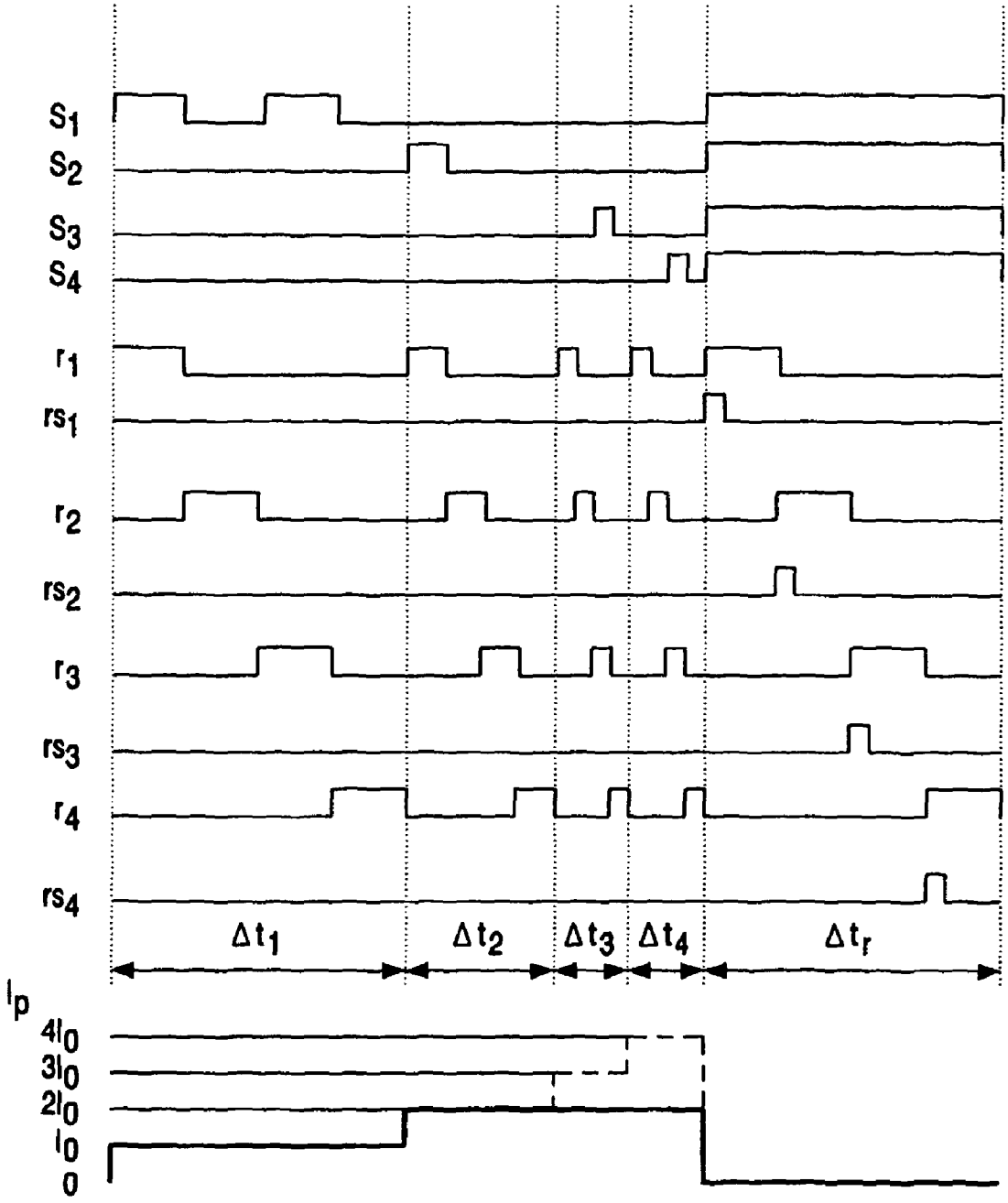
Figure 17:
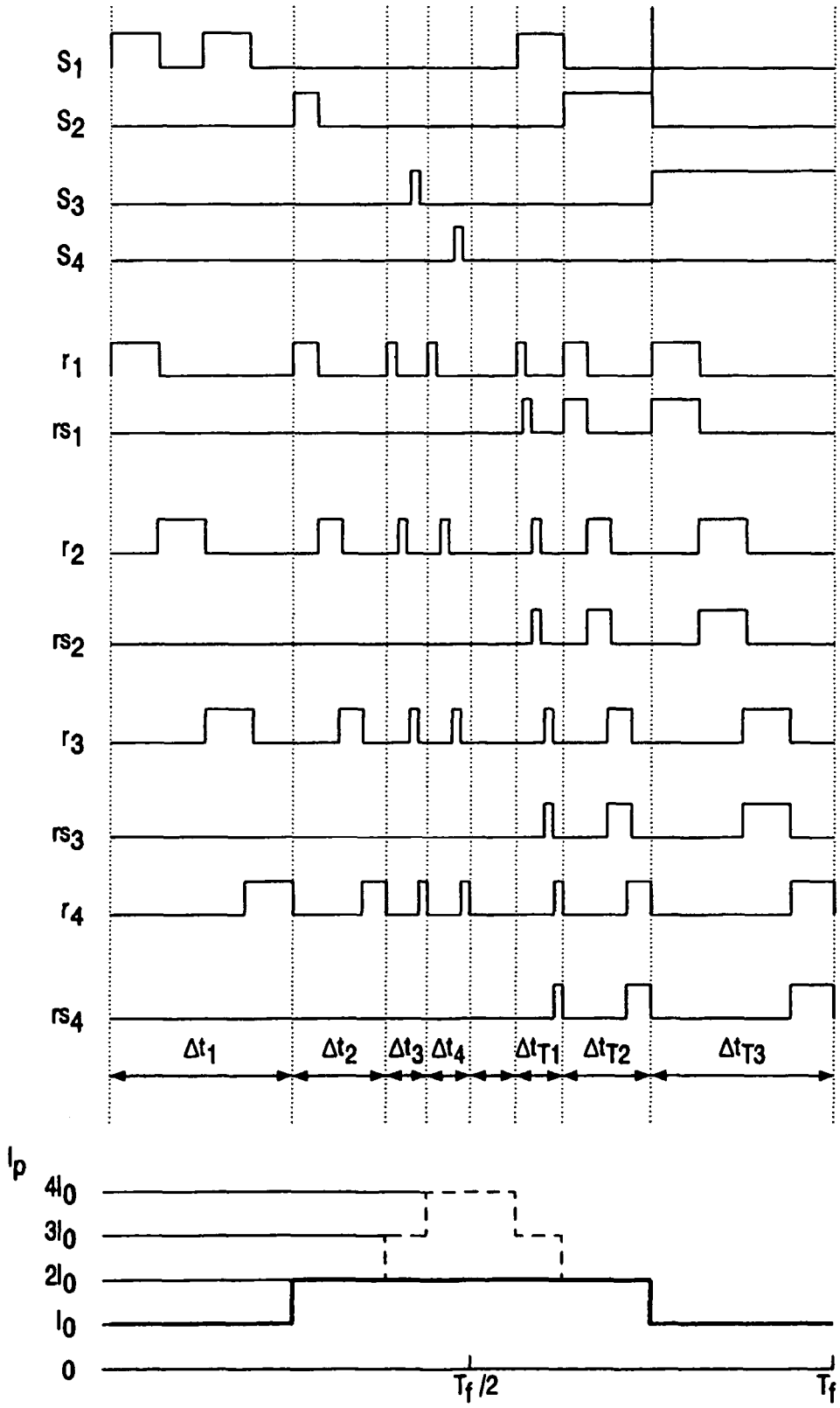

The invention will now be explained in further detail with reference to the accompanying drawings, in which:

FIG. 1 shows schematically a section of a first embodiment of the active matrix display according to the invention, FIG. 2 shows schematically an embodiment of a pixel circuit in a simplified version of the embodiment of the active matrix display shown schematically in FIG. 1, FIG. 3 shows schematically a section of a second embodiment of the active matrix display according to the invention, FIG. 4 shows schematically a section of a third embodiment of the active matrix display according to the invention, FIG. 5 shows schematically a section of a fourth embodiment of the active matrix display according to the invention, FIG. 6 shows schematically an embodiment of a pixel circuit suitable for use in a simplified version of the embodiment of an active matrix display shown in FIG. 4, FIG. 7 shows schematically a different embodiment of a pixel circuit suitable for use in a simplified version of the embodiment of an active matrix display shown in FIG. 4, FIG. 8 shows schematically a section of a generalised fifth embodiment of the active matrix display panel according to the present invention, FIG. 9 shows schematically an embodiment of a current mirror circuit for use in various embodiments of the active matrix display panel of the invention, FIG. 10 shows schematically an embodiment of a pixel circuit comprising two current-memory stages for use in various embodiments of the active matrix display panel of the invention, FIG. 11 shows schematically an embodiment of a pixel circuit for use in a sixth embodiment of the active matrix display panel according to the invention, FIG. 12 shows schematically a simplified embodiment of a pixel circuit functioning in a similar fashion to the sixth embodiment shown in FIG. 11, FIG. 13 shows schematically a variant of the sixth embodiment shown in FIG. 11, FIG. 14 shows schematically a time-diagram of the signals provided to drive the embodiment shown in FIG. 1, FIG. 15 shows schematically a time-diagram of the signals provided to drive the embodiment shown in FIG. 4, FIG. 16 shows schematically a time-diagram of the signals provided to drive an active matrix display panel comprising a pixel circuit as shown in FIG. 12 according to a first embodiment of the method according to the invention, FIG. 17 shows schematically a time-diagram of the signals provided to drive an active matrix display panel comprising a pixel circuit as shown in FIG. 12 according to a second embodiment of the method according to the invention.

In FIG. 1, a much-simplified section of a column in a first embodiment of an active matrix display panel according to the invention is shown. Four pixel circuits 1*a*-1*d* are arranged in a column on a substrate of the active matrix display panel. The substrate may be made of glass or another suitable inorganic material, such as steel, into which the pixel circuits 1*a*-1*d* have been formed, for example by etching and/or deposition of material. Alternatively, the substrate may be made of an organic material with suitable optical properties. For simplicity, it will be assumed that each pixel circuit comprises an organic light-emitting diode (OLED) 2*a*-2*d*. It is observed that the invention can also be implemented in other types of emissive display panels, in which the intensity of the light emitted by a pixel is determined by the value of a current flowing through a light-emitting element in the pixel. Examples include electro luminescent display panels and Field Emission Display panels. Of course a Polymer LED (PLED) may be used instead of the small molecules OLEDs 2*a*-2*d*. PLEDs and OLEDs are known in the art and not described in further detail here. As used herein, the term pixel circuit is used to refer to a unit comprising one light-emitting element. Other references sometimes also refer to such a unit as a sub pixel circuit, since each light-emitting element is often arranged to emit light of one colour, so that three such units are used to form what is then referred to as a pixel in a colour display panel.

Each of the embodiments of the invention is used to display a sequence of frames on the active matrix display panel. The description of the invention will focus on how a frame is built up on the active matrix display panel. The driving circuitry that drives the pixel circuits in a group within a column receives a set of data including an intensity value for each pixel circuit in the group at a certain point in time. This is the information encoding a frame as it is understood in the context of this description. The next frame in the sequence, for which the driving circuitry receives another set of data, is to be displayed at a next period in time. The interval in between these periods determines the frame period, i.e. the time available for adjusting the current flowing through the light-emitting element in each pixel circuit in accordance with one received set of data.

The embodiment shown in FIG. 1 is arranged to be driven purely sequentially, in a manner to be described in further detail below. For this reason, only one column line 3 is shown in FIG. 1. The column line may be shared with an adjacent column of pixel circuits (not shown). The column line 3 is arranged to conduct a reference current $I_{ref}$ provided by a current driving circuit. The column line 3 is embedded on or in the substrate and comprises a terminal (not shown), by means of which it can be connected to a current driving circuit. The current driving circuit, when connected, imposes the reference current $I_{ref}$. The current driving circuit lies outside the area of the substrate on which the pixel circuits are arranged. It may be external to the active matrix display panel, i.e. not located on the substrate at all. In this case, the column line 3 will run to the edge of the substrate or to a surface of the substrate opposite to that on which the pixel circuits 1*a*-1*d* are arranged, terminating in contact terminals for connection to an external driving circuit. Each of the pixel circuits 1*a*-1*d* comprises four current mirrors 4*a*-4*p*. Each is arranged to mirror the reference current $I_{ref}$ to an output, but not necessarily for the entire duration of a frame period. Within each pixel circuit 1, the four current mirrors 4 comprise a current-memory stage having an output terminal connected to the OLED 2. Thus, the points at which the output terminals are connected form adders 5*a*-5*d*, since the sum of the currents through the output terminals flows through the light-emitting element. In this embodiment, the OLEDs 2 are fed by means of a common supply line (not shown in FIG. 1), and the current mirrors 4 each draw a current through adders 5. It will be understood that the term drawing as used herein does not imply a particular direction of current flow. It is also intended to encompass the reverse situation in which the OLEDs 2 are connected in reverse orientation, to a common potential (e.g. ground), and a current flows from each current mirror 4 through the adder 5 and the OLED 2 to, for example, ground.

Thus, each current mirror 4 determines a contribution to the current determining the intensity of light emitted by the OLED 2. This, in itself, already confers the advantage that the reference current $I_{ref}$ is approximately one fourth of what it would be if the pixel circuits 1 were to comprise only one current mirror 4. Thus, the difference in current $I_{ref}$ between a pixel that is fully on and one that is fully off is much smaller, so that the parasitic capacitance of the column line 3 has a much smaller influence on the accuracy with which a current through the OLED 2 can be set. To allow sequential driving, however, the current-memory stages in the current mirrors 4 further comprise a storage element for storing a signal value determining a current flowing through the output of that current-memory stage, and thus the output of the current mirror 4. For each row of pixel circuits 1*a*-1*d*, there is also a row selection line 6*a*-6*d*. Each current-memory stage in each of the pixel circuits 1*a*-1*d* comprises a row select switch, responsive to a signal on the associated one of the row selection lines 6*a*-6*d*. The row select switch is comprised in a circuit section for providing a signal to the storage element. Each of the current mirrors 1*a*-1*d* further comprises a sub-frame select switch connected to and responsive to one of K sub-frame select signals $s_k$. The sub-frame select switch is comprised in a circuit section between the input of the current mirror 4 and the storage element. Thus, it is possible to set each of the signal values stored in the K current-memory stages in turn, by closing the sub-frame select switches in turn and providing the appropriate reference current $I_{ref}$ on the column line 3. When the sub-frame select switch is then opened again, the signal value is maintained, and consequently the same current is drawn through the output of the current mirror 4, regardless of subsequent values of $I_{ref}$.

In the embodiment of FIG. 1, the sub-frame select signals $s_k$ are provided directly by driver circuits (not shown), by means of data bit select lines 7*a*-7*d*. The data bit select lines 7*a*-7*d* thus form addressing circuitry having four input terminals for receiving driving information from a display driver connected to the active matrix display panel, and are arranged to convert the information into sub-frame select signals $s_k$, and to supply the sub-frame select signals $s_k$ to the sub-frame select switches in the current mirrors 4. It is noted that the conversion in this case is a one-to-one conversion, i.e. no changes are made to the signals received from the display driver in this example.

The pixel circuits 2 may be implemented in various ways. FIG. 2 shows an example of a simplified pixel circuit. The pixel circuit is simplified relative to those of FIG. 1 in the sense that the pixel circuit shown in FIG. 2 only comprises first and second current mirrors 8*a*,8*b*, each including a current-memory stage, and arranged to mirror a reference current $I_{ref}$ flowing through a column line 9. Consequently, there are only two data bit select lines 10*a*,10*b*. The outputs of the current-mirrors 8*a*,8*b* are connected in parallel at a node 11. The first and second current mirrors 8*a*,8*b* contribute to the current drawn through an OLED 12 and the node 11. To arrive at a pixel circuit as shown in FIG. 1, the circuit between the node 11 and the column line 9 need merely be copied once.

The composition of a current mirror 8 will be explained with reference to the first current mirror 8*a*. The composition of the second current mirror 8*b* is substantially the same. The first current mirror 8*a* comprises a matched input transistor 13 and output transistor 14. Because the input transistor 13 and output transistor 14 are both located in the pixel circuit, matching is relatively easy to achieve, since they are close together on the substrate. It is noted that variants of all embodiments of the invention are possible in which there is a well-defined matching ratio between input transistor 13 and output transistor 14, and in which the matching ratio varies in a defined manner between the current mirrors 8*a*,8*b* in the pixel circuit. In this variant, one reference current value can be provided through the column line 9, but the current drawn through the node 11 varies according to the current mirror 8 that is selected to mirror the reference current $I_{ref}$. Thus, the current drawn through the OLED 12 is a sum of weighted contributions, selected in accordance with the driving information.

The first current mirror 8*a* comprises a current-memory stage, formed by the output transistor 14 and a storage capacitor 15. A row select switch 16 and a first sub-frame select switch 17 are connected between the input transistor 13 and the storage capacitor 15. Another type of analogue storage device or circuit may be used in the place of the storage capacitor 15, but the shown embodiment has the advantage of simplicity. A second sub-frame select switch 18 is connected between the input of the first current mirror 8*a* and the input transistor 13. The row select switch 16 is responsive to a signal on a row selection line 19, whereas the first and second sub-frame select switches 17,18 are responsive to the sub-frame select signal on a first data bit select line 10*a*. When both the row select switch 16 and the first and second sub-frame select switches 17,18 are closed, the reference current $I_{ref}$ flowing through the column line 9 is mirrored to the output of the first current mirror 8*a*. Simultaneously, the storage capacitor 15 is charged to the voltage differential between gate and source of the output transistor 14. When any one of the switches 16-18 is opened, the voltage differential is maintained by the storage capacitor 15, which thus determines the current drawn by the first current mirror 8*a* when it is not being addressed. The OLED 12 is connected to a common power supply 20, which is the same for each pixel circuit. The person skilled in the art will realise that the pixel circuit shown in FIG. 2 can straightforwardly be implemented using PFET-transistors, rather than NFET-transistors as are shown. In that case, the common power supply 20 is simply held at a lower voltage level than the drain of the input and output transistors 13,14, and the OLED 12 is connected in the reverse direction to the one shown in FIG. 2. The same holds true for all the other embodiments illustrated here.

As mentioned, the display driver will usually be external to the substrate, or at least located at the edge of the surface area on which the pixel circuits are arranged. Therefore, the data bit select lines 7 (FIG. 1) run the length of the column of pixel circuits 1. This has the advantage of making the pixel circuit layout simple.

In the embodiment of FIG. 3, less space need be reserved for the addressing circuitry that runs along the length of the column. There is also more spacing between conductors, reducing the risk of cross talk. In this embodiment, the addressing circuitry comprises two addressing lines 21*a*,21*b* and a decoder 22*a*-22*d* in each of four pixel circuits 23*a*-23*d*. Each decoder 22 has a number of inputs equal to the number of addressing lines 21, i.e. two in this example. Each decoder 22 has a number of outputs equal to the number of current mirrors 24*a*-24*p* in a pixel circuit 23 comprising a current-memory stage, i.e. four in this case. Note that the layout of the current mirrors 24*a*-24*p* is preferably identical to that of the first current mirror 8*a* of FIG. 2, discussed above. The decoder 22 converts a digital value communicated over the two addressing lines 21 into sub-frame select signals to be supplied to sub-frame select switches in the current mirrors 24. It will be appreciated that a reduction in the number of lines running substantially along the entire length of the column is thus achieved. With the two addressing lines 21*a*,21*b*, four different combinations of sub-frame select signals can be achieved, which is sufficient if no current mirrors 24 are to simultaneously mirror a reference current $I_{ref}$ flowing through a single column line 25, to which each of the current mirrors 24*a*-24*p* is connected.

It is noted that two or more pixel circuits 23 may share a decoder 22, in order to reduce the number of decoders 22, and thus the complexity of the active matrix display panel. There is no danger of pixel circuits 23 in the same column being simultaneously programmed by means of a reference current $I_{ref}$, as each current mirror 24 comprises a row select switch and is connected to a separate one of four row selection lines 26*a*-26*d*. FIG. 3 illustrates an example in which binary coding is used. In general, the use of multilevel logics will allow the control of even more decoder 22 or a further reduction in the number of addressing lines 21.

The active matrix display panel of FIG. 3 is otherwise identical to that of FIG. 1, and is also intended to be driven purely sequentially. This means that the current-memories in each of the current mirrors 24 are selected in turn to mirror a reference current $I_{ref}$, and to maintain the last mirrored reference current when they are no longer selected. The currents flowing through the outputs of the current mirrors 24 are added at nodes 27*a*-27*d* in the pixel circuits 23, such that the sum of the currents drawn by the current mirrors 24 is drawn through OLEDS 28*a*-28*d* in the pixel circuits 23. The manner of driving the active matrix display panel is described in further detail below.

FIG. 4 shows a variant of the invention that is intended to be driven purely in parallel. This means that a plurality of reference currents are simultaneously, but selectively, mirrored in each of four pixel circuits 29*a*-29*d*, shown for the purposes of illustrating the concept of this variant, when that pixel circuit 29 is addressed.

In the shown embodiment, there are four column lines 30*a*-30*d*, through which four reference currents $I_{ref1}$-$I_{ref4}$ with the same or a different value can be provided by a display driver. The pixel circuits 29 are identical to those of the embodiment shown in FIG. 1. Each comprises a current mirror circuit, formed by the four current mirrors 31*a*-31*p*. However, in the context of the present application, a slightly different terminology is used to distinguish between active matrix display panels to be driven in parallel and those to be driven sequentially. Thus, instead of sub-frame select signals, this application will speak of feed select signals when used to drive an active matrix display panel in parallel. This is done because the feed select signals are preferably provided together once every frame period to each current mirror circuit, instead of being supplied individually once every sub-frame period, as is the case for sequentially driven display panels. The same principle is used, however, since each of four reference currents $I_{ref1}$-$I_{ref4}$ on the column lines 30*a*-30*d* defines a contribution to the current drawn through an OLED 32*a*-32*d* in a pixel circuit 29, and since an adder, formed by a node 33*a*-33*d*, to which the four current mirrors 31 in each pixel circuit 29 are connected in parallel, is used to add the contributions. As is the case for the sequentially driven embodiments of FIGS. 1-3, the current drawn through the node 33 is the output of a (possibly weighted) current mirror 31, so that the panel is current-driven. As is the case for the embodiments of FIGS. 1 and 3, the reference currents $I_{ref1}$-$I_{ref4}$ have smaller values, due to the use of an adder to add the mirrored current contributions. By means of the use of current mirror switches controlled by feed select signals, which are supplied over bit select lines 34*a*-34*d*, current contributions are selectively added in accordance with driving information received by a display driver, so that little or no variations in reference current need occur.

Note that, as was the case for the embodiments of FIGS. 1 and 3, each of the pixel circuits 29*a*-29*d* is connected to a corresponding one of four row selection lines 35*a*-35*d*. Reference currents flowing through the column lines 30*a*-30*d* are mirrored by, and a signal value determining the mirrored current is stored in, a current mirror 31 only in response to a row select signal on the corresponding row selection line 35.

In view of the similarity between sub-frame select signals and feed select signals, it will come as no surprise to those skilled in the art that the decoders 22 of FIG. 3 can also be used in the embodiment of FIG. 4. That is to say, the addressing circuitry arranged to convert driving information into N feed select signals and to supply each feed select signal to an associated one of the current mirror switches may comprise a number of addressing lines smaller than the number of feed select switches. A decoder, connected to the addressing lines by means of separate inputs and to each of the feed select switches associated with a current mirror by means of a separate output for each current mirror, is arranged to convert a digital value communicated over the addressing lines into a combination of feed select signals encoded by the digital value. Again, there may be a separate decoder for each of the current mirror circuits, or it may be shared by a plurality of them.

FIG. 5 shows pixel circuits 36*a*-36*d* comprising a different type of decoder 37. These decoders 37*a*-37*d* comprise a shift register and are controlled by a signal on a clock line 38. Thus, only a single clock line 37 need run from the display driver past the pixel circuits 36*a*-36*d*. In this case, the digital values to be converted into a combination of feed select signals are effectively provided to the decoder 37 sequentially. Those skilled in the art will realise that additional addressing lines could be used in conjunction with the clock line 38, in order to be able to use a lower clock frequency.

In use, reference currents $I_{ref1}$-$I_{ref4}$ flow through column lines 39*a*-39*d*. Within a frame period a row select signal is provided to a pixel circuit 36 through one of four row selection lines 40*a*-40*d*. Simultaneously, a binary code is serially provided through the clock line 38 to the decoders 37. By means of the shift register, the binary code can be converted into a combination of feed select signals, which are provided to current mirrors 41*a*-41*p* in the pixel circuits 36. If the pixel circuit 36 is addressed via a row selection line 40, then the reference currents $I_{ref1}$-$I_{ref4}$ are selectively mirrored by the current mirrors 41*a*-41*p*, in accordance with the feed select signals provided by the decoder 37. After the pixel circuit 36 is deselected, the mirrored currents are maintained. As the outputs of the current mirrors 41 in a pixel circuit 36 are connected in parallel at a node 42 in the pixel circuit 36, the sum of the mirrored or maintained currents is drawn through an OLED 43 in the pixel circuit 36.

FIG. 6 shows an alternative to the pixel circuit of FIG. 2, suitable for use in an embodiment of the active matrix display panel similar to that of FIGS. 4 and 5, but with only two column lines 44*a*,44*b*, instead of four. The pixel circuit comprises a first and second current mirror 45*a*,45*b*, of which the outputs are connected in parallel at a node 46, which forms an adder. The first current mirror 45*a* comprises an input transistor 47 and an output transistor 48, which are matched according to a well-defined matching ratio, e.g. one-to-one.

The first current mirror 45*a* comprises a feed-select switch 49, responsive to a feed-select signal on a first bit select line 50*a*. The sum of the current contributions added at the node 46 is provided to the input of a third current-mirror 51, comprising an input transistor 52 and an output transistor 53, which are matched. The third current mirror 51 comprises a current-memory stage, formed by the output transistor 53 and a storage capacitor 54. A row select switch 55 determines whether the current drawn through the node 46 is mirrored to the output of the third current-mirror 51, and thus drawn through an OLED 56, or whether the last-mirrored current, as determined by the voltage stored by the storage capacitor 54, is drawn. The row select switch 55 is responsive to a row select signal on a row selection line 57.

It will be recalled that in all of the described embodiments, the current mirrors in the current mirror circuit are selectively connected to the associated column line (purely sequential) or column lines (parallel), in accordance with the driving information supplied by the current driving circuit. Thus, whenever a pixel circuit in a certain row is selected by means of a signal on the associated row selection line, a reference current flowing through a column line is either mirrored to an adder or not. This depends on the driving information, which translates into a number of binary feed select signals (parallel) or sub-frame select signals (purely sequentially driven display panel). If no measures were to be taken, then the current driver supplying the reference current would see a different input impedance when the reference current is mirrored from when it is not. In order to keep the input impedance substantially constant, the various embodiments of the invention comprise a number of current dumping circuit stages corresponding at least to the number of column lines, and each connectable to an associated one of the column lines by means of a switch responsive to one of the feed select signals supplied to the current mirror switches controlling an associated current mirror, such that a connection between a column line and a current dumping circuit stage is established when the connection between the column line and each of the current mirror outputs is interrupted.

FIG. 6 clearly shows a separation of two functions that contribute to the advantageous effect of the invention, namely the copying of reference currents and the storing of current values. For proper operation, the polarity of the current mirrors 45,51 should be well chosen, for example by including in first and second current mirrors 45*a,b* complementary type transistors with respect to the third current mirror 51.

FIG. 7 shows a variant of the pixel circuit of FIG. 2, in which the current dumping circuit stages are comprised in the pixel circuits. As before, the pixel circuit comprises a first current mirror 58*a* and a second current mirror 58*b*. The first current mirror 58*a* comprises an input transistor 59 and an output transistor 60, as well as a first and second row select switch 61,62 and a feed select switch 63. Furthermore, the first current mirror 58*a* comprises a current-memory stage, formed by the output transistor 60 and a storage capacitor 64. The feed select switch 63 thus controls supply of a mirrored reference current flowing through one of two column lines 65*a*,65*b* by the first current mirror 58*a*, in response to a signal on an associated one of two bit select lines 66*a*,66*b*. If the feed select switch 63 is closed, the reference current is mirrored and supplied to a node 67 at which the outputs of the first and second current mirrors 58*a*,58*b* are connected in parallel. Through the node 67, the outputs of the current mirrors 58*a*, 58*b* are also connected to an OLED 68. If the feed select switch 63 or row select switches 61,62 are not closed, the output transistor 60 draws a current determined by the voltage stored in the storage capacitor 64.

In use, whenever the pixel circuit is addressed by means of a signal on a row selection line 69 associated with the pixel circuit, the first and second row select switches 61,62 close. Thus, a connection between the input transistor 59 and the first column line 65*a* is established. If a feed select signal is also supplied by means of the first bit select line 66*a*, then the feed select switch 63 is closed, and the reference current is mirrored. Otherwise, the reference current is not mirrored, but the input transistor 59 is still connected to the first column line 65*a*, so that the input impedance as determined by the input transistor 59 is independent of the position of the feed select switch 63. Thus, the input transistor 59 functions as a local current dump.

FIG. 8 shows a generalised embodiment of the active matrix display panel according to the invention, which is a combination of the purely sequentially driven embodiments of FIGS. 1 and 3 and the embodiments to be driven only in parallel of FIGS. 4 and 5. In addition, FIG. 8 shows a number of features that may also be implemented in variants of the embodiments of FIGS. 1, 3, 4 and 5.

In the embodiment of FIG. 8, pixel circuits 70*a*,70*b* in a column are also divided into groups. However, each group now comprises M pixel circuits, with M being larger than one. In the shown example, M=2. Thus, the shown pixel circuits 70*a*,70*b* belong to the same group. Both pixel circuits 70 comprise an OLED 71*a*,71*b*. The active matrix display panel comprises N column lines 72*a*-72*d* for each column, each arranged to conduct a reference current I.sub.n (n=1 . . . N), provided by a current driving circuit (not shown) when connected to the panel. In this example, N=4. One current mirror circuit 73 is associated with the group to which the M pixel circuits 70 belong. The current mirror circuit 73 comprises a current mirror circuit comprising N current mirrors 74*a*-74*d*, each arranged to mirror a current flowing through one of the N column lines 72 to a current mirror output. As can be seen, the current mirrors 74 are connected in parallel, so that the currents flowing through the N current mirror outputs are added at a node 75.

FIG. 9 shows an embodiment of a current mirror circuit that is suitable for use in a local current adder in which N=2. It comprises a first current mirror 76*a* and a second current mirror 76*b*. The current mirror outputs are connected in parallel at a node 77, which forms an adder. Reference currents flowing through first and second column lines 78*a* and 78*b* are selectively mirrored by the first and second current mirror 76*a*,76*b* respectively. This depends on whether first and second feed select switches 79*a*,79*b* are closed in response to feed select signals provided by means of first and second bit select lines 80*a*,80*b*, respectively. Note that this will only be the case if first and second row select switches 81*a*, 81*b*, respectively are closed in response to a row select signal on either one of M row selection lines 82*a*-82*b*, each associated with one of the M pixel circuits. It is noted that the first and second current mirrors 76*a*,76*b* of FIG. 9 correspond substantially to the first and second current mirrors 45*a*,45*b* shown in FIG. 6.

Returning to FIG. 8, each of the m pixel circuits 70*a*,70*b* comprises K current mirrors 83*a*-83*f*, K being larger than one. In this example, K=3. FIG. 10 shows an example of a pixel circuit in which K=2. The pixel circuit comprises a first and second current mirror 84*a*,84*b*. The first current mirror comprises an input transistor 85 and an output transistor 86, as well as a first and second sub-frame select switch 87,88 and a first and second row select switch 89,90. It further comprises a storage capacitor 91. The second current mirror 84*b* corresponds in layout to the first current mirror 84*a*. The outputs of the first and second current mirrors 84*a*.84*b* are connected in parallel at a node 92. By means of this node 92, they are also connected to an OLED 93. The inputs of the first and second current mirrors 84*a*,84*b* are connected to the local column line 94.

Note that the layout of the first and second current mirrors 84*a*,84*b* corresponds substantially to that of the first and second current mirrors 8*a*,8*b* shown in FIG. 2. Thus, the first and second current mirrors 84*a*,84*b* each also comprise a current memory stage. In the first current mirror 84*a*, this current memory stage comprises the storage capacitor 91 and the output transistor 86. The current-memory stages comprised in the first and second current mirrors 84*a*,84*b* comprise an output connected to the OLED 93 through the node 92. As was described with reference to FIG. 2, the storage capacitor 91 is arranged to store a voltage determining a current flowing through the output of the first current mirror 84*a*. Note also that the first and second sub-frame select switches 87,88 are responsive to sub-frame select signals on first and second data bit select lines 95*a*,95*b*, and are situated in a circuit section between the input of the first current mirror 84*a* and the storage capacitor 91. When the first and second sub-frame select switches 87,88 are closed and the first and second row select switches 89,90 are also closed—in response to a signal on a row selection line 96—a new voltage value, determining a current mirrored from the current on the local column line 94 is set in the storage capacitor 91.

Returning to FIG. 8, it will be seen that, to address a first pixel circuit 70*a* in the group of M pixel circuits, a row select signal is provided on a first of two row selection lines 97*a*, 97*b*. Four reference currents are provided through the column lines 72*a*-72*d*. Feed select signals are provided through bit select lines 98*a*-98*d*. Thus, the reference currents flowing through the column lines 72*a*-72*d* are selectively mirrored to outputs of the current mirrors 74*a*-74*d*. The mirrored currents are added and the sum flows through a local column line 99. By means of K sub-frame select signals, provided through data bit select lines 100*a*-100*c*, the reference current through local column line 99 is selectively mirrored by the K current mirrors 83 that comprise a current memory stage. The sum of the output currents of the current memory stages, which is thus determined at least partly by the current mirrored by each of the current mirrors 74 in the current mirror circuit 73, is drawn through an OLED 71. In each of the current mirrors 83 comprising a current memory stage, a value determining the current drawn through the output is stored in a storage element comprised in the current memory stage. Thus, when no row select signal is present on a row selection line 97, or when no sub-frame select signal is provided to one of the current mirrors 83, the current memory stage in that current mirror 83 ensures that the last mirrored current continues to be drawn through the OLED 71.

Although the parasitic capacitance of the local column line 99 may affect the speed at which the M pixel circuits 70 may be addressed, it is noted that the local column line 99 can be much shorter, as the current mirror circuit 73 will be situated at a shorter distance to the M pixel circuits 70 than to the edge of the display panel and need only connect the inputs of the current mirrors 83 in each of the pixel circuits 70 to the output of the current mirror circuit 73.

It is further noted that the embodiment can be further refined by providing further local current adders for each group of M pixel circuits and a number of local column lines corresponding to the number of local column lines. Thus, differently valued reference currents can be provided in parallel to the M pixel circuits. Local addressing circuitry and extra feed select switches in the current mirrors of the pixel circuit are used in such an embodiment to selectively mirror the reference currents provided via the local column lines.

The current mirrors 74 in the current mirror circuit 73 may comprise current dumping circuit stages. In that case, they comprise a variant of the first current mirror 58*a* of FIG. 7. FIG. 8 shows an alternative, in which a separate current dumping circuit 101 is provided for the group of M pixel circuits 69. The current dumping circuit 101 comprises N current dumping circuit stages 102*a*-102*d*. A first current dumping circuit stage 102*a* is connectable to a first column line 72*a* by means of a switch 103. The first current dumping circuit stage 102*a* is responsive to a feed select signal on a first bit select line 98*a*, which signal is first passed through an inverter 104. Thus, the switch 103 is closed when no feed select signal is present on the first bit select line 98*a*, and open when there is. The first current dumping circuit stage 102*a* comprises a transistor 105, which is matched to the input transistor of the first current mirror 74*a*. Thus, a current driver connected to the first column line 72*a* always 'sees' the same input impedance, regardless of whether a feed select signal is provided through the first bit select line 98*a*.

It will be appreciated that the number N of bit select lines 98*a*-98*d*, as well as the number K of data bit select lines 100*a*-100*c* can be reduced by making use of decoders such as the decoder 22 described in connection with FIG. 2 or the decoder 37 described in connection with FIG. 5.

FIG. 11 shows a further embodiment of a pixel circuit, intended to be driven purely sequentially. Thus, it could be used in place of the pixel circuits shown in FIGS. 1, 3 and 8. FIGS. 12 and 13 show variants of this pixel circuit, connected to two types of addressing circuitry.

In FIG. 11, a pixel circuit comprises first, second and third current mirrors 106*a*-106*c*. The first, second and third current mirrors 106*a*-106*c* are arranged to mirror a reference current flowing through a column line 107 to their respective current mirror outputs. Each current mirror output coincides with the output of a current memory stage comprised in the current mirror. In the case of the first current mirror 106*a*, the current memory stage comprises an output transistor 108 of the first current mirror 106*a* and a storage capacitor 109. The outputs of the first, second and third current mirrors 106*a*-106*c* are connected in parallel to an OLED 110 through a node 111 in the pixel circuit. Thus, each current-memory stage is capable of drawing a current determined at least partly by the current mirrored to the first current mirror output through the output terminal and thus through the OLED 110.

The first current mirror 106*a* comprises first and second sub-frame select switches 112,113, responsive to a sub-frame select signal on a first data bit select line 114*a*. Second and third data bit select lines 114*b*,114*c* convey sub-frame select signals to the second and third current mirrors 106*b*,106*c* respectively. The first current mirror 106*a* further comprises first and second row select switches 115,116, responsive to a row select signal on a row selection line 117. Both row select switches 115,116 are comprised in a circuit section of the first current mirror that supplies a voltage to the storage capacitor 109. Note that the voltage stored in the storage capacitor 109 determines the value of the current drawn through the output of the current-memory stage comprised in the first current mirror 106*a*.

The current-memory stage comprised in the first current mirror 106*a* further comprises a reset switch 118, responsive to a reset signal on a reset line 119. When a reset signal is supplied through the reset line 119, the storage capacitor 109 is discharged. Thus, the voltage value is adjusted to the default value of 0 V. The gate to source voltage differential over the output transistor 108 is therefore also set to the default value of 0 V, so that substantially no current will flow through the output of the current-memory stage. Other default reset values are, of course, possible.

When no reset signal is supplied to the reset switch 118, a connection between an input transistor 120 and the second sub-frame select switch 113 and second row select switch 116 is maintained, so that the current-memory stage can be programmed in the usual way, as described above.

The second and third current mirrors 106*b*,106*c* correspond in layout to the first current mirror 106*a*.

FIG. 12 shows in a simplified manner another embodiment of a pixel circuit 121 with current-memory stages that can be reset by means of a reset signal on a reset line 122. The pixel circuit 121 comprises four current mirrors 123*a*-123*d*, similar in lay-out to the first, second and third current mirrors 106*a*-106*c* of FIG. 11. Each has an output connected to an OLED 124, which is connected to a supply voltage. The current mirrors 123*a*-123*d* are connected to ground via a common supply line 125. Again, a configuration in which the current mirrors 123 are connected to a supply voltage via the common supply line 125 and in which the OLED 124 is connected to ground and oriented in the other direction is also possible.

Each of the current mirrors 123*a*-123*d* comprises a current-memory stage with an output coinciding substantially with the current mirror output and connected to the OLED 124. Each current-memory stage comprises a storage element for storing a signal value determining a current flowing through the output. Each current-memory stage further comprises a sub-frame select switch, responsive to one of four sub-frame select signals. In FIG. 12, the sub-frame select signals are provided through data bit select lines 126*a*-126*d*, each connected to an associated one of the four current mirrors 123*a*-123*d*. As in previously described embodiments, the sub-frame select signal, together with a row select signal supplied by a row selection line 127, determines whether a reference current flowing through a column line 128 is mirrored by the current mirror 123 to which it is connected. When each row select switch and sub-frame select switch in a current mirror 123 is on, the current on the column line 128 is mirrored to the current mirror output. Otherwise, a current determined by the signal value stored in the storage element in the current-memory stage flows through the current mirror output.

Each current mirror 123 further comprises a reset switch, responsive to a reset signal on the reset line 122, to adjust the signal value stored by the storage element to a default value, e.g. a value determining that substantially no current is to be drawn through the current mirror output. The reset switch is only operative when the current mirror is simultaneously also supplied with a sub-frame select signal.

In FIG. 13, the addressing circuitry for supplying the feed-select signal to a pixel circuit 129 has been simplified by means of a decoder 130. The decoder 130 is connected to each of two addressing lines 131*a*, 131*b*, by means of two associated inputs. It is further connected to four current mirrors 132*a*-132*d*, and in particular to the sub-frame select switches comprised in them, by means of four separate outputs. The decoder 130 converts a digital value communicated over the two addressing lines 131*a*,131*b* into a combination of sub-frame select signals, which are supplied to the associated sub-frame select switches. In the shown embodiment, sub-frame select signals are supplied separately, i.e. spaced apart in time, to the associated current mirrors, so that only four combinations of select signals are possible. The two addressing lines 131 therefore suffice to encode these four combinations. The decoder 130 is situated on the substrate in the vicinity of the pixel circuit 129 (in fact is comprised in the pixel circuit 129 in the shown embodiment). Thus, a reduction in the number of lines that run substantially along the full length of the column of pixels is achieved (two instead of four).

FIG. 13 shows an example of an implementation of the decoder 130 using switching transistors 133*a*-133*h*. These comprise N-type and P-type transistors. The example of FIG. 13 is provided to give an example of an implementation of switches, such as are used in all embodiments of the invention shown herein. Thus, each of the sub-frame select switches, feed select switches, row select switches and reset switches shown schematically can be implemented by means of switching transistors. Of course, other implementations will be obvious to the skilled person.

Apart from the decoder 130, the pixel circuit 129 of FIG. 13 is identical to that of FIG. 12. As in previously described embodiments, the sub-frame select signal, together with a row select signal supplied by a row selection line 134, determines whether a reference current flowing through a column line 135 is mirrored by the current mirror 132 to which it is connected. When each row select switch and sub-frame select switch in a current mirror 132 is on, the current on the column line 135 is mirrored to the current mirror output. The current drawn through the current mirror output is also drawn through an OLED 136 in the pixel circuit 129. In the absence of a row select signal and a relevant feed sub-frame select signal, a current determined by the signal value stored in the storage element in the current-memory stage flows through the current mirror output.

Each current mirror 132 further comprises a reset switch, responsive to a reset signal on the reset line 137, to adjust the signal value stored by the storage element to a default value, e.g. a value determining that substantially no current is to be drawn through the current mirror output. The reset switch is only operative when the current mirror 132 is simultaneously also supplied with a sub-frame select signal.

The methods that may be used to drive the various embodiments of the active matrix display panel discussed will now be explained in further detail. In each of the embodiments, for each pixel circuit, a reference current through a column line is set to a first level within a frame period and mirrored by a first current mirror, so that it is drawn through a light-emitting element in that pixel circuit and, within the same frame period a reference current is mirrored by at least one further current mirror connected in parallel to the first current mirror, and the mirrored currents are added. For each embodiment, it may be advantageous to insert a non-emissive period within the frame time to avoid motion time artefacts. In this case the time diagram should be adjusted to incorporate this possibility.

To explain a manner of driving the active matrix display panel according to the invention in a purely sequential fashion, reference will be made to FIG. 1. Assume that the four pixel circuits 1*a*-1*d* form a complete column. FIG. 14 shows the development of sub-frame select signals $s_k$, k=1 . . . 4, supplied by means of data bit select lines 7*a*-7*d*, and row select signals $r_1$-$r_4$, supplied by means of row selection lines 6*a*-6*d*, during exactly one frame period.

In the shown embodiment, the frame period is divided into K sub-frame periods $\Delta t_k$ and K current settling periods. In FIG. 14, the sub-frame periods $\Delta t_k$ within a frame period are of equal length. Within each sub-frame period $\Delta t_k$, a row select signal $r_1$-$r_4$ is supplied on each of the row selection lines 6*a*-6*d*. In the shown embodiment, there are K current settling periods, because the reference current $I_{ref}$ through the column line 3 is set to a different value before the start of each sub-frame period $\Delta t_k$. In embodiments in which the reference current $I_{ref}$ remains constant over two consecutive sub-frame periods, no current settling period need be present between those two sub-frame periods. During the current settling period, no row select signal is supplied on any of the row selection lines 6*a*-6*d*, so that none of the current mirrors 4*a*-4*p* are operative. This is advantageous, as the reference current $I_{ref}$ is not well defined within the current settling period, due to the parasitic capacitance of the column line 3.

In the shown embodiment, a different value reference current $I_{ref}$ is set for each sub-frame period $\Delta t_k$ and the values are binary weighted, with the most significant value being provided first, i.e. being selectively mirrored during the first sub-frame period $\Delta t_1$. The second reference current value is half the level of the first, the third half of that, etc. Thus, the current settling periods may be different for proper settling to the intended level.

In the shown embodiment, currents to be drawn through the OLEDs 2*a*-2*d* can be programmed by means of a digital value. For example, the value to be supplied to the OLED 2*a* in the first pixel circuit 1*a* is programmed as '1100', the value of the current through the second OLED 2*b* is programmed as '0000', the value of the current through the third OLED 2*c* is '1010' and that through the fourth OLED 2*d* is '0001'.

Due to the inclusion of a current-memory stage in each of the current mirrors 4, a current mirrored during the first sub-frame period of one frame period is maintained until at least the first sub-frame period of the next frame period, i.e. for the duration of one frame period. Note that this is not necessarily the case when the embodiments of FIGS. 11-13, which comprise reset lines, are driven, as will be explained later.

Suppose that no current flows through the OLED 2*a* of the first pixel circuit 1*a* at the start of the shown frame period. If the current level corresponding to the least significant bit is 10 nA, then the current flowing through the OLED 2*a* at the end of the frame period is: 1×80 nA+1×40 nA+0×20 nA+0×10 nA=120 nA.

FIG. 15 shows how the same current levels can be programmed for the embodiment shown in FIG. 4, which is driven in a purely parallel fashion. As four reference currents $I_{ref1}$-$I_{ref4}$ on the respective column lines 30*a*-30*d* are set simultaneously, there is only one current settling period within a frame period. The duration of the current settling period equals the time needed for the current corresponding to the least significant bit to settle. The remainder of the frame period is divided into four periods $\Delta t_1$-$\Delta t_4$. Note that, compared with FIG. 14, the section of the frame period reserved for current settling is shorter. During each period, feed select signals are provided to one of the four pixel circuits 29*a*-29*b* shown in FIG. 4 and a row select signal is provided over the row selection line 35 associated with that pixel circuit 29. Thus, the reference currents $I_{ref1}$-$I_{ref4}$ are selectively mirrored by the current mirrors 31*a*-31*d* in the first pixel circuit 29*a* during the period marked as $\Delta t_1$, in accordance with the values of the feed select signals $b_1$-$b_4$ during that period.

FIG. 16 illustrates one method of driving an active matrix display panel in which a column comprises four pixel circuits like the pixel circuit 121 shown in FIG. 12. In this embodiment, the pixel circuits are also driven sequentially. However, instead of varying the reference current $I_{ref}$ through the column line 128 in between binary weighted values, the reference current $I_{ref}$ is held constant throughout the frame period (and between one frame period and the next). Thus, no time need be reserved to allow the reference current $I_{ref}$ to settle to its intended value. To achieve the same effect, namely an increase in the number of intensity values that can be programmed, the four sub-frame periods $\Delta t_1$-$\Delta t_4$ vary in length according to binary weighted values. In alternative embodiments the variation in length may be according to another pattern. In the shown embodiment, the first sub-frame period is the longest, and the length of the sub-frame periods decreases in the order in which the corresponding sub-frame select signals $s_1$-$s_4$ are provided. It is noted that the length of the sub-frame periods $\Delta t_1$-$\Delta t_4$ can also be varied in this fashion in a variant of the method illustrated in FIG. 14, and that the reference current values can also be varied in level when driving an active matrix display panel incorporating the pixel circuit 121 of FIG. 12, in which case the frame period further comprises current settling periods, as shown in FIG. 14.

In FIG. 16, the frame period further comprises a reset period $\Delta t_r$. During the reset period $\Delta t_r$, each pixel circuit in the column is addressed in turn, by providing a row select signal to the pixel circuit. Concurrently, a reset signal is provided, to each current-memory stage in a current mirror of the pixel circuit comprising such a current-memory stage. The reset signal is provided simultaneously with a sub-frame select signal closing the sub-frame select switches in the current mirrors. Thus, the signal value stored by the storage element in the current-memory stage is reset to a default value, determining that no current is to flow through the output of the current-memory stage, and thus through the light-emitting element connected to it.

For example, if the pixel circuit 121 of FIG. 12 were to be the first pixel circuit in a column comprising four such pixel circuits, and the addressing signals shown in FIG. 16 were to be provided, the development of the current through the OLED 124 would be that marked as $I_p$ in FIG. 16, if the reference current through the column line 128 were to equal $I_0$. At the start of the first sub-frame period $\Delta t_1$, a row select signal is provided over row selection line 127 and a $I_0$ first sub-frame select signal is provided over a first data bit select line 126*a*. The reference current through the column line 128 is thus mirrored by the first current mirror 123*a*, which comprises a current-memory stage. A value determining that the current through the output of the memory stage is to remain at $I_0$ is retained in the storage element of the current-memory stage in the first current mirror 123*a*.

At the start of the second sub-frame period $\Delta t_2$, the process is repeated for the second current mirror 123*b* in the pixel circuit 121. The current mirrored (and thereafter maintained) by the second current mirror 123*a* adds to the current drawn by the first current mirror 123*b*, so that the current through the OLED 124 is now $2I_0$. No sub-frame select signals are provided at the start of the third and fourth sub-frame periods $\Delta t_3$, $\Delta t_4$, because the value to be programmed happens to be '1100'.

At the start of the sub-frame reset period $\Delta t_r$, a sub-frame reset signal is provided over reset line 122, together with a row select signal over row selection line 127 and sub-frame select signals on all four data bit select lines 126*a*-126*d*. Thus, the values determining the current drawn by each of the four current mirrors comprising a current memory stage with a reset switch is reset to the default value of zero. No more current is drawn through the OLED 124. Note that, also due to the fact that the sub-frame periods are of varying length, the most significant bit in the value '1100' corresponds to the highest contribution to the overall perceived intensity, as it determines that a current contribution $I_0$ is to be drawn through the OLED 124 for the duration of the entire frame period minus the reset period $\Delta t_r$.

Using the method of driving an active matrix display panel illustrated in FIG. 16, all four current mirrors 122 are switched off abruptly at the start of the sub-frame reset period $\Delta t_r$. This has the advantage that the OLED 124 can emit light for the duration of a relatively large section of the frame period, so that higher intensity values can be achieved, or higher perceived intensity values can be achieved with lower currents (the light is effectively integrated in the perception of the beholder of the display panel). However, abruptly switching off pixels row for row can lead to artefacts in the image displayed by an active matrix display panel driven in this way. FIG. 17 illustrates an alternative manner of driving an active matrix display panel in which at least one of the current-memory stages in the pixel circuits comprises at least one reset switch.

In this variant of the driving method, a signal value for storage in the storage element is selectively provided to a different one of a number of the current-memory stages in each sub-frame period in order, and wherein the reset signals are provided to each of the number of current-memory stages in reverse order. As is shown in FIG. 16, reset periods $\Delta t_{r1}$-$\Delta t_{r3}$ define the spacing between the points in time at which reset signals are provided to the current-memory stages in the pixel circuit. The duration of the reset periods $\Delta t_{r1}$-$\Delta t_{r3}$ corresponds substantially to that of the sub-frame periods $\Delta t_r$-$\Delta t_3$, but in reverse order, i.e. $\Delta t_{r1}=\Delta t_3$, $\Delta t_{r2}=\Delta t_2$, $\Delta t_{r3}=\Delta t_1$. Thus, the build-up and reduction of the current through a light-emitting element in the pixel circuit is substantially symmetrical, which helps to prevent visible artefacts, especially when fast moving images are being displayed.

Assume again that the pixel circuit 121 of FIG. 12 is the first pixel circuit in a column comprising four such pixel circuits, and that the addressing signals shown in FIG. 17 are provided. Thus, the digital value programmed into pixel circuit 121 is '1100'. The development of the current through the OLED 124 would be that marked as $I_p$ in FIG. 17, if the reference current through the column line 128 were to equal $I_0$. The dotted lines show what the development of the current would look like if the maximum digital value '1111' were to be programmed.

During the first sub-frame period $\Delta t_1$, a row select signal is provided on row selection line 127. Simultaneously, a sub-frame select signal is provided on the first data bit select line 126*a*, corresponding to the most significant bit in the digital value to be programmed. This activates the first current-mirror 123*a* to mirror a reference current equal to $I_0$ to its output, and thus to source the current to the OLED 124. A storage element in the first current mirror 123*a* stores a signal value determining that the current $I_0$ is to be maintained when the first current-mirror 123*a* is no longer selected. Within the first frame period $\Delta t$1, a first sub-frame select signal is also selectively provided to the other three pixel circuits. At the start of the second sub-frame period $\Delta t_2$, a sub-frame select signal is provided on the second data bit select line 126*b* simultaneously with a row select signal on row selection line 127. This activates the second current mirror 123*b*, so that the reference current with value $I_0$ is also mirrored by the second current mirror 123*b*. The total current through the OLED 124 is now $2I_0$. At the start of the third and fourth sub-frame periods $\Delta t_3$, $\Delta t_4$, no sub-frame select signal is provided on third and fourth data bit select lines 126*c*,126*d*. After a period of time corresponding to the fourth sub-frame selection period $\Delta t_4$, a row select signal is provided on row selection line 127, a reset signal is provided on reset line 122 and a sub-frame select signal is provided on the fourth data bit select line 126*d*, to reset the current-memory stage in the fourth current mirror 123*d*. Note that this has no effect in this specific example, as no current was being drawn by the fourth current mirror 123*d* anyway. Variants of the method are possible in which the reset signal is only provided to current mirrors that are drawing a current with a non-default value. However, this would require extra logic and memory in the display driver. At the start of the second reset period $\Delta t_{r2}$, a reset signal and row select signal are again provided to the pixel circuit 121. A sub-frame select signal is provided on the third data bit select line 126*c*. At the start of the third reset period $\Delta t_{r3}$, a row select signal is provided on the row selection line 127, a reset signal on the reset line 122 and a sub-frame select signal on the second data bit select line 126*b*. Thus, the current through the OLED 124 is reduced from $2I_0$ to $I_0$. In the shown variant, no reset signal is provided to the first current mirror 123*a*. However, a variant in which this is done is also within the scope of the invention.

Although it has been assumed throughout this description, that the reference current on a column line stays constant for at least the duration of a sub-frame period, embodiments of the invention are possible in which the reference current through a column line is modulated. This further increases the range of available grey levels. When the modulation is limited to a fraction of the total current to be stored, the associated voltage swing of the current reference line is small and a fast settling can be obtained. The modulation fraction is chosen to compromise between number of grey-levels, circuit complexity and settling time.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements, and by means of a suitably programmed computer. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. Active matrix display panel, comprising a substrate, an array of pixel circuits being arranged in a matrix of at least one column and a plurality of rows on the substrate, each pixel circuit comprising a light-emitting element, capable of emitting light of an intensity determined by the value of a current passed through it, and at least N column lines for each column of pixel circuits, N being larger than one, each column line arranged to conduct a reference current, provided by a current driving circuit, when connected to the panel, wherein the pixel circuits in a column are divided into a plurality of groups of at least one pixel circuit, wherein the active matrix display panel comprises at least one current mirror circuit associated with a first group, comprising a first current mirror, arranged to mirror a reference current flowing through a column line to a first current mirror output, wherein each pixel circuit in the first group comprises at least a first current-memory stage, having an output terminal connected to the light-emitting element, wherein the first current-memory stage is capable of drawing a current determined at least partly by the current mirrored to the first current mirror output through the output terminal, wherein each current mirror circuit comprises at least one additional current mirror, arranged to mirror a reference current flowing through an associated column line to an additional current mirror output, and wherein each additional current mirror output is connected in parallel to the first current mirror output, wherein the current mirror circuit comprises at least N current mirrors, each arranged to mirror a reference current flowing through an associated one of the column lines to a current mirror output of the current mirror, and an adder for adding currents flowing through the current mirror outputs.

2. Active matrix display panel according to claim 1, comprising a row selection line for each row of pixel circuits, wherein at least the first current-memory stage comprises a row select switch, responsive to a signal on the row selection line, and a storage element for storing a signal value determining a current flowing through the output terminal, wherein the row select switch is comprised in a circuit section for providing a signal to the storage element.

3. Active matrix display panel according to claim 1, wherein the current mirror circuit comprises at least one feed select switch, interrupting a connection between a current mirror output of an associated current mirror and a column line and responsive to one of at least one feed select signals, wherein the active matrix display panel comprises addressing circuitry, connectable to a display driver for receiving driving information, and arranged to supply each feed select signal to the feed select switches associated to one of the current mirrors.

4. Active matrix display panel according to claim 3, wherein the addressing circuitry comprises at least one addressing line and at least one decoder, connected to the addressing lines by means of separate inputs, and to each of the feed select switches associated with each current mirror by means of a separate output for each current mirror, the decoder being arranged to convert a digital value communicated over the addressing lines into a combination of feed select signals encoded by the digital value.

5. Active matrix display panel according to claim 3, wherein the at least one addressing lines comprise a clock line and the decoder comprises a shift register, controlled by a signal on the clock line and arranged to supply the feed select signals to the outputs.

6. Active matrix display panel according to claim 3, comprising at least N current dumping circuit stages, each connectable to one of the N column lines by means of a switch, and responsive to one of the N feed select signals supplied to the feed select switches controlling an associated current mirror, such that a connection between a column line and a current dumping circuit stage is established when the connection between the column line and each of the current mirror outputs is interrupted.

7. Active matrix display panel according to claim 1, wherein each pixel circuit in the first group comprises K current mirrors, K being larger than one, a storage element for storing a signal value determining a current flowing through the output and a sub-frame select switch, responsive to one of K sub-frame select signals, wherein each sub-frame select switch is comprised in a circuit section between the input of the current mirror and the storage element, wherein each of the K current mirrors has an input and a current-memory stage comprising an output connected to the light-emitting element the active matrix display panel comprises addressing circuitry, having at least one input terminal for receiving driving information from a display driver connected to the active matrix display panel, and arranged to supply each sub-frame select signal to an associated one of the K sub-frame select switches.

8. Active matrix display panel according to claim 6, wherein the addressing circuitry comprises at least Y addressing lines for each column, Y being equal to or larger than one, and at least one decoder, situated on the substrate and connected to each of the addressing lines by means of an associated one of Y inputs and to each of the K sub-frame select switches by means of a separate one of K outputs, the decoder being arranged to convert a digital value communicated over the Y addressing lines into K sub-frame select signals and to supply each sub-frame select signal to an associated one of the K sub-frame select switches.

9. Active matrix display panel according to claim 8, wherein the Y addressing lines comprise a clock line and the decoder comprises a K-shift register, controlled by a signal on the clock line and arranged to supply the K sub-frame select signals to the K outputs.

10. Active matrix display panel according to claim 1, comprising substantially identical copies of the circuitry associated with the first group of pixel circuits, wherein each of the other groups of pixel circuits is associated with one of the copies.

11. Active matrix display panel according to claim 1, comprising at least one further column of pixel circuits, wherein the pixel circuits in each further column are divided into a plurality of groups of at least one pixel circuit, wherein the active matrix display panel comprises at least one current mirror circuit associated with a first group in a further column, comprising a first current mirror and at least one additional current mirror with outputs connected in parallel, each arranged to mirror a reference current flowing through a column line to a first current mirror output, wherein each pixel circuit in the first group of the further column comprises at least a first current-memory stage, having an output terminal connected to the light-emitting element, wherein the first current-memory stage is capable of drawing a current determined at least partly by the current mirrored to the first current mirror output through the output terminal, and wherein the at least one current mirror in the first group of the column and at least one current mirror in the first group of a further column are arranged to mirror a reference current flowing through a shared column line.

12. Display device, comprising an active matrix display panel according to claim 1.

13. Active matrix display panel, comprising a substrate, an array of pixel circuits being arranged in a matrix of at least one column and a plurality of rows on the substrate, each pixel circuit comprising a light-emitting element, capable of emitting light of an intensity determined by the value of a current passed through it, and at least on column line, each column line arranged to conduct a reference current, provided by a current driving circuit, when connected to the panel, wherein the pixel circuits in a column are divided into a plurality of groups of at least one pixel circuit, wherein the active matrix display panel comprises at least one current mirror circuit associated with a first group, comprising a first current mirror, arranged to mirror a reference current flowing through a column line to a first current mirror output, wherein each pixel circuit in the first group comprises at least a first current-memory stage, having an output terminal connected to the light-emitting element, wherein the first current-memory stage is capable of drawing a current determined at least partly by the current mirrored to the first current mirror output through the output terminal, wherein each current mirror circuit comprises at least one additional current mirror, arranged to mirror a reference current flowing through an associated column line to an additional current mirror output, and wherein each additional current mirror output is connected in parallel to the first current mirror output, comprising a row selection line for each row of pixel circuits, wherein at least the first current-memory stage comprises a row select switch, responsive to a signal on the row selection line, and a storage element for storing a signal value determining a current flowing through the output terminal, wherein the row select switch is comprised in a circuit section for providing a signal to the storage element, wherein the first group comprises M pixel circuits, M being larger than one, wherein the active matrix display panel comprises a local column line for the first group, connecting an output of the adder in the current mirror circuit to an input of a current mirror in each of the M pixel circuits comprising the first current-memory stage.

14. Active matrix display panel, comprising a substrate, an array of pixel circuits being arranged in a matrix of at least one column and a plurality of rows on the substrate, each pixel circuit comprising a light-emitting element, capable of emitting light of an intensity determined by the value of a current passed through it, and at least on column line, each column line arranged to conduct a reference current, provided by a current driving circuit, when connected to the panel, wherein the pixel circuits in a column are divided into a plurality of groups of at least one pixel circuit, wherein the active matrix display panel comprises at least one current mirror circuit associated with a first group, comprising a first current mirror, arranged to mirror a reference current flowing through a column line to a first current mirror output, wherein each pixel circuit in the first group comprises at least a first current-memory stage, having an output terminal connected to the light-emitting element, wherein the first current-memory stage is capable of drawing a current determined at least partly by the current mirrored to the first current mirror output through the output terminal, wherein each current mirror circuit comprises at least one additional current mirror, arranged to mirror a reference current flowing through an associated column line to an additional current mirror output, and wherein each additional current mirror output is connected in parallel to the first current mirror output, wherein each pixel circuit in the first group comprises K current mirrors, K being larger than one, a storage element for storing a signal value determining a current flowing through the output and a sub-frame select switch, responsive to one of K sub-frame select signals, wherein each sub-frame select switch is comprised in a circuit section between the input of the current mirror and the storage element, wherein each of the K current mirrors has an input and a current-memory stage comprising an output connected to the light-emitting element the active matrix display panel comprises addressing circuitry, having at least one input terminal for receiving driving information from a display driver connected to the active matrix display panel, and arranged to supply each sub-frame select signal to an associated one of the K sub-frame select switches, comprising at least one reset line, wherein at least one current-memory stage comprises a reset switch, responsive to a reset signal on the reset line to adjust the signal value stored by the storage element to a default value.

15. Active matrix according to claim 14, wherein the default value determines that substantially no current flows through the output of the current-memory stage.

* * * * *